US009889679B2

(12) United States Patent
Kuwabara et al.

(10) Patent No.: US 9,889,679 B2
(45) Date of Patent: Feb. 13, 2018

(54) APPLICATION DEVICE AND IMAGE FORMING SYSTEM

(71) Applicants: Akitomo Kuwabara, Kanagawa (JP); Kazuhiro Akatsu, Kanagawa (JP); Yutaka Nagasawa, Chiba (JP); Yuuji Ohmura, Kanagawa (JP); Hirotaka Kobayashi, Kanagawa (JP); Hirofumi Ohkushi, Kanagawa (JP)

(72) Inventors: Akitomo Kuwabara, Kanagawa (JP); Kazuhiro Akatsu, Kanagawa (JP); Yutaka Nagasawa, Chiba (JP); Yuuji Ohmura, Kanagawa (JP); Hirotaka Kobayashi, Kanagawa (JP); Hirofumi Ohkushi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/367,621

(22) Filed: Dec. 2, 2016

(65) Prior Publication Data

US 2017/0165981 A1 Jun. 15, 2017

(30) Foreign Application Priority Data

Dec. 11, 2015 (JP) ..... 2015-242574

(51) Int. Cl.
*B41J 11/00* (2006.01)

(52) U.S. Cl.
CPC ..... *B41J 11/0015* (2013.01)

(58) Field of Classification Search
CPC ..... B41J 11/0015; B41J 2/2114; B41J 29/38; B41J 13/223; B41J 11/0045; B41J 15/04; B41J 2002/012; B41J 29/393; B41J 2/0057
USPC ..... 347/16, 21, 28, 101, 103, 104
See application file for complete search history.

(56) References Cited

U.S. PATENT DOCUMENTS

2015/0338758 A1* 11/2015 Numata ..... G03G 15/10 399/237
2016/0263913 A1 9/2016 Akatsu et al.

FOREIGN PATENT DOCUMENTS

JP 2014-024224 2/2014
JP 2014-058118 4/2014

* cited by examiner

*Primary Examiner* — Jannelle M Lebron
(74) *Attorney, Agent, or Firm* — Cooper & Dunham LLP

(57) ABSTRACT

An application device includes a conveyer to convey a recording medium, an application roller to apply a treatment liquid to the recording medium, a pressure roller to sandwich the recording medium with the application roller to press the recording medium against the application roller, and a winding member to form a curved conveying path to have the recording medium curved along a conveying direction to wind the recording medium around the pressure roller. The pressure roller comes in contact with the application roller when applying the treatment liquid and separates from the application roller when not applying the treatment liquid. A predetermined positional relationship is maintained between the pressure roller and the winding member while the pressure roller moves close to the application roller to be in contact with the application roller, or the pressure roller moves away from the application roller to be separated from the application roller.

11 Claims, 17 Drawing Sheets

APPLICATION DEVICE AND IMAGE FORMING SYSTEM

CROSS-REFERENCE TO RELATED APPLICATIONS

The present application claims the benefit of priority under 35 U.S.C. § 119 of Japanese Patent Application No. 2015-242574, filed on Dec. 11, 2015, the contents of which are incorporated herein by reference in their entirety.

BACKGROUND OF THE INVENTION

1. Field of the Invention

The present disclosure relates to an application device and an image forming system.

2. Description of the Related Art

In inkjet recording systems, there is disclosed in the related art an example of a technique to apply a treatment liquid for aggregating ink immediately before ink droplets land on a sheet of paper of a recording medium in order to improve image quality.

There is also known in the related art another example of the technique to apply such a treatment liquid on an entire surface of a sheet using rollers. FIG. 12 depicts a configuration example of an application unit as a treatment liquid application device (hereinafter also referred simply to as an "application device") configured to apply a treatment liquid using such rollers. In FIG. 12, W indicates a recording medium such as paper, 90 represents an application unit, 91 represents a container, L represents a liquid such as a treatment liquid, 92 represents a squeeze roller, 93 represents an application roller, and 94 represents a pressure roller 94. In this example, the treatment liquid is scooped by rotations of the squeeze roller 92 driven by a motor. The treatment liquid scooped by the squeeze roller 92 is partially scraped by a nip between the application roller 93 wrapped by an elastic member such as rubber and the squeeze roller 92, and the remaining liquid is thinly and uniformly spread over the application roller 93. The treatment liquid spread on the application roller 93 is transferred on a sheet sandwiched by an application nip formed between the pressure roller 94 and the application roller 93 (see Patent Document 1).

The elastic member wrapped around the application roller 93 may be quickly deteriorated when the application roller 93 retains in contact with the squeeze roller 92 or the pressure roller 94. The positions of the application roller 93, the squeeze roller 92 and the pressure roller 94 may be adjusted to allow the application roller 93 to be in contact with the squeeze, roller 92 and the pressure roller 94 only for applying the liquid, and be separated from the squeeze roller 92 and the pressure roller 94 while not applying the liquid.

RELATED-ART DOCUMENTS

Patent Documents

Patent Document 1: Japanese Unexamined Patent Application Publication No. 2014-024224

Patent Document 2: Japanese Unexamined Patent Application Publication No. 2014-058118

SUMMARY OF THE INVENTION

It is a general object in one embodiment of the present invention to provide an application device and an image forming system capable of preventing a recording medium from creasing while preventing deterioration of the application roller, when applying a treatment liquid to the recording medium having flexure in different width directions at a contact part between the application roller and the pressure roller.

According to an aspect of embodiments, there is provided an application device that includes a conveyer configured to convey a recording medium; an application roller configured to apply a treatment liquid to the recording medium; a pressure roller configured to sandwich the recording medium with the application roller to press the recording medium against the application roller; and a winding member disposed close to the pressure roller and configured to form a curved conveying path to have the recording medium curved with respect to a conveying direction to wind the recording medium around the pressure roller. In the application device, the pressure roller comes in contact with the application roller when applying the treatment liquid to the recording medium, and separates from the application roller when not applying the treatment liquid to the recording medium, and a predetermined positional relationship is provided between the pressure roller and the winding member in a period in which the pressure roller moves close to the application roller to be in contact with the application roller or in a period in which the pressure roller moves away from the application roller to be separated from the application roller.

Other objects, features and advantages of the present invention will become more apparent from the following detailed description when read in conjunction with the accompanying drawings.

BRIEF DESCRIPTION OF THE DRAWINGS

FIG. 3A is a schematic diagram illustrating an application mechanism in a pretreatment liquid spreading direction of the application roller, and FIG. 3B is a schematic diagram illustrating an application mechanism in a roller axis direction of the application roller;

FIG. 4A is a schematic diagram illustrating the application mechanism in a pretreatment liquid spreading direction of the application roller, and FIG. 4B is a schematic diagram illustrating the application mechanism in a roller axis direction of the application roller;

FIG. 6A illustrates a separate status where the pressure roller separates from the application roller and FIG. 6B illustrates a contact status where the pressure roller is in contact with the application roller;

FIG. 8A illustrates a separate status where the pressure roller separates from the application roller and FIG. 8B illustrates a contact status where the pressure roller is in contact with the application roller;

DETAILED DESCRIPTION OF THE PREFERRED EMBODIMENTS

When the related art treatment liquid application device for use in inkjet printers applies a treatment liquid to a continuous sheet such as a roll sheet, the flexure of the sheet (i.e., the recording medium W) may be formed in different width directions due to sheet properties or variability in thickness directions of the sheet. The recording medium W may become wavy by separating the application roller 93, the squeeze roller 92, and the pressure roller 94 for preventing deterioration of the elastic member covering the application roller 93.

Figure 13:
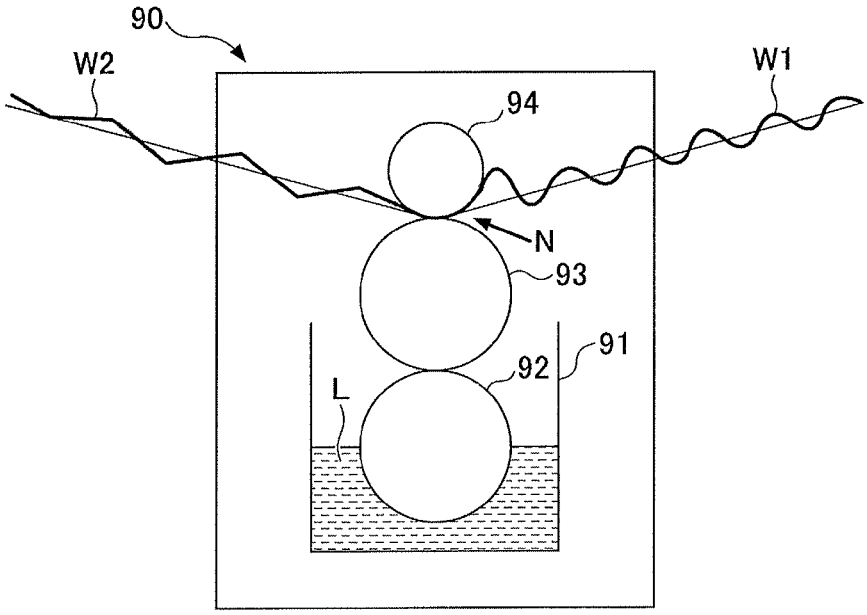
FIG.13 RELATED ART
FIG. 13 is a diagram illustrating creases formed in the application unit of FIG. 12.

In FIG. 13, waves W1 at upstream of the application nip N indicate appearance of a recording medium W such as a wavy sheet caused by properties of the sheet or variability in the thickness directions. When the waves W1 formed in the recording medium W sandwiched between the application roller 93 and the pressure roller 94 reach the application nip N, the waves W1 are flattened to form a crease W2. The creases W2 in the recording medium W at downstream of the application nip N illustrate a result of the waves W1 flattened by the application nip N.

Figure 14:
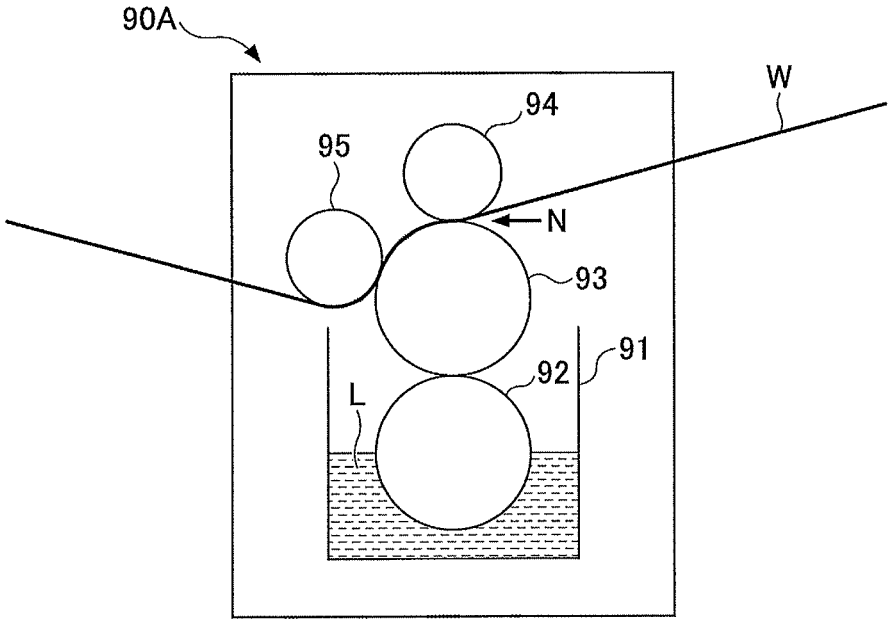
FIG.14 RELATED ART
FIG. 14 is a schematic diagram illustrating another example of a related art application unit.

In general, the waves W1 caused by the flexure may be reduced by increasing tension of the recording medium when applying the liquid to the sheet. Hence, the sheet may be prevented from creasing by the tension of the sheet. FIG. 14 depicts another example of a related art application unit 90A (see Patent Document 2). In the application unit 90A, the amount of liquid applied to the sheet is adjusted by having a winder 95 to wind the recording medium W around the application roller 93. However, when the waves W1 are formed in the recording medium W before reaching the application nip N in the application unit 90A as illustrated in FIG. 14, the waves W1 that have reached the application nip N are flattened by the application nip N to form additional creases W2. Thus, it appears that the creases are not completely removed by the configuration of the application unit 90A.

Figure 1:
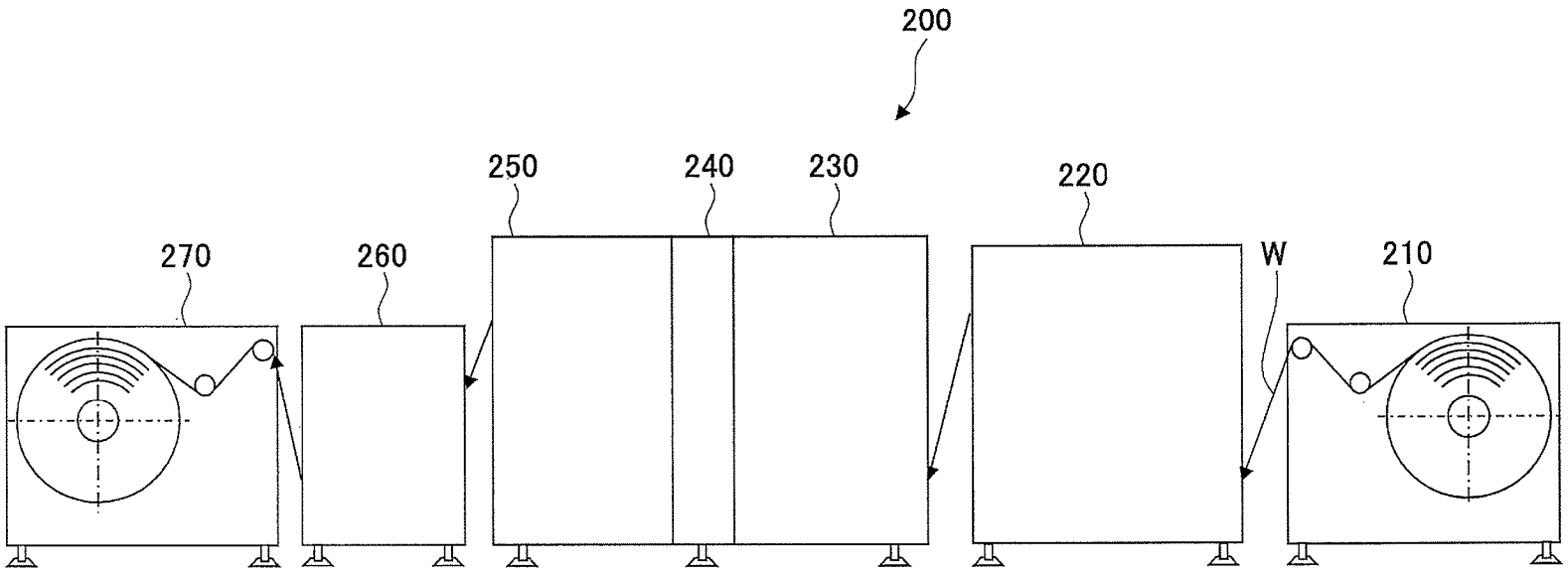
FIG. 1 is a schematic diagram illustrating a flow of an image forming system of an inkjet system according to an embodiment.

The following describes embodiments of the present invention with reference to accompanying drawings. FIG. 1 is a configuration diagram illustrating an embodiment of the present invention. More specifically, FIG. 1 is a schematic diagram illustrating an inkjet image forming system (i.e., an inkjet printing system) 200 according to an embodiment.

In FIG. 1, a recording medium (recording medium or web) W of a continuous sheet rolled out of a roll paper feeder 210 is fed to a pretreatment device 220 including application mechanisms 331 and 332. The pretreatment device 220 is configured to apply a treatment liquid (also called a "pretreatment liquid" or a "treatment liquid") serving as a coating material having a property of aggregating ink droplets landing on an image forming surface of the recording medium W. The treatment liquid may be applied to one side or two sides of the recording medium W according to desired printed matter.

The recording medium W is subsequently transferred to first and second inkjet printers 230 and 250 (recording devices) at downstream of the pretreatment device 220 in a conveying direction of the recording medium W. The recording device having the first and second inkjet printers 230 and 250 ejects ink droplets on a surface of the recording medium W to which the treatment liquid is applied to form a desired image on the surface of the recording medium W. The recording device may further include a reversing device 240 in addition to the first and second inkjet printers 230 and 250. To print two sides of the recording medium W, the first inkjet printer 230 forms an image on a first surface of the recording medium W, the reversing device 240 subsequently reverses the recording medium W to feed the reversed recording medium W to the second inkjet printer 250, and the second inkjet printer 250 ejects ink droplets on a second surface (rear surface) of the recording medium W, thereby forming desired images.

The recording medium W on which the desired images are formed is conveyed to a posttreatment device 260 to apply a desired posttreatment to the recording medium W. After the posttreatment is applied, the recording medium W is rolled up by a roller 270 as illustrated in FIG. 1. The posttreatment may be folding or cutting instead of rolling up.

Figure 2:
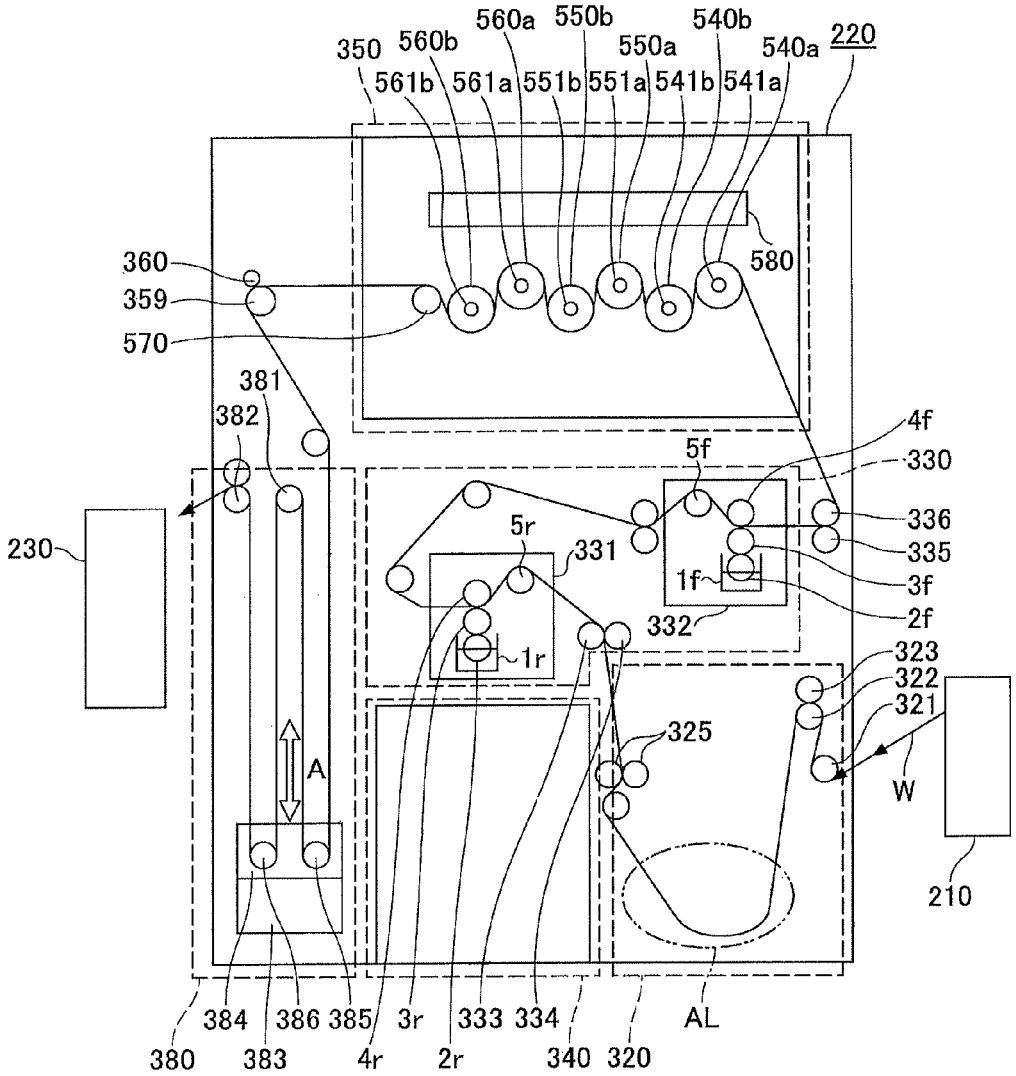
FIG. 2 is a schematic diagram illustrating an application device for use in the image forming system according to the embodiment.

FIG. 2 is a schematic diagram illustrating the pretreatment device 220 for use in the image forming system 200 according to an embodiment. The pretreatment device 220 is configured to apply a pretreatment liquid L and evaporate the applied pretreatment liquid L. The pretreatment device 220 includes a pretreatment liquid L application unit (a pretreatment liquid L application device) 330 having the application mechanisms 331 and 332 configured to apply the pretreatment liquid L to the recording medium W. A heater unit (a recording medium heating device) 350 is disposed downstream of the pretreatment liquid L application unit 330 in a direction of conveying the recording medium W in order to evaporate the pretreatment liquid L applied to the recording medium W.

The pretreatment device 220 further includes an air loop unit 320, a pretreatment liquid L supply unit 340, and a dancer unit 380.

The air loop unit 320 includes a rotationally supported guide roller 321, and a feed-in (FI) roller 322 and FI nip roller 323 that sandwich the recording medium W to convey the recording medium W. The guide roller 321, the rotationally driving FI roller 322, and the rotationally driven FI nip roller 323 convey the recording medium W fed from a paper feeder 210 to allow the recording medium W to be drawn into the air loop unit 320. At this moment, the rotation of the FI roller 322 is controlled by an optical sensor to form an air loop AL to allow the recording medium W to have uniform flexure. The recording medium W passing through the air loop AL that has tension applied by a tension shaft for stabilizing the conveyance is conveyed to the pretreatment liquid L application unit 330.

The recording medium W via the air loop AL passes through two edge guides. The recording medium W passes through two path shafts 325 that have longitudinal directions orthogonal to a longitudinal direction (an arrow direction) of the recording medium W so that the recording medium W passes through the two path shafts in an S-shape. The recording medium W having passed the edge guides and the path shafts 325 has tension applied by the fixed tension shaft for stabilizing the conveyance.

The pretreatment liquid L application unit 330 includes a rotationally driven infeed roller 333, a feed nip roller 334, a rear surface application mechanism 331, and a surface application mechanism 332. The pretreatment liquid L application unit 330 further includes an application controller 81 (see FIG. 10) configured to control the rear surface application mechanism 331 and the surface application mechanism 332. A rotationally driving outfeed roller 335 and a feed nip roller 336 are disposed close to the pretreatment liquid L application unit 330.

The feed nip roller 334 is configured to sandwich the recording medium W with the infeed roller 333, and the feed nip roller 336 is configured to sandwich the recording medium W with the outfeed roller 335. The infeed roller 333 and the feed nip roller 334 serve as a recording medium conveying unit.

The rear surface application mechanism 331 includes a squeeze roller 2*r*, an application roller 3*r*, a pressure roller 4*r*, and a winding roller 5*r*. The squeeze roller 2*r* is disposed inside a supply pan 1*r* containing the pretreatment liquid L so that the squeeze roller 2*r* applies the pretreatment liquid L to the application roller 3*r*. Accordingly, the pretreatment liquid L is applied to one side (the rear surface) of recording medium W by the application roller 3*r* while the recording medium W is sandwiched and carried by the application roller 3*r* and the pressure roller 4*r*. The recording medium W that passes through the rear surface application mechanism 331 is carried to the surface application mechanism 332.

The surface application mechanism 332 includes a supply pan 1*f*, a squeeze roller 2*f*, an application roller 3*f*, a pressure roller 4*f*, and a winding roller 5*f* to apply the pretreatment liquid L to an outer surface (surface) of the recording medium W. The recording medium W that passes through the surface application mechanism 332 is carried by the outfeed roller 335 and the feed nip roller 336 to a heater unit 350 serving as a heater.

The rear surface application mechanism 331 and the surface application mechanism 332 are controlled to be selectively activated to selectively apply the pretreatment liquid L to one side or both sides of the recording medium W.

The pretreatment liquid L supply unit 340 pools the pretreatment liquid L in order to appropriately supply the pretreatment liquid L to the rear surface application mechanism 331 and the surface application mechanism 332.

The heater unit 350 includes heating rollers 540*a*, 540*b*, 550*a*, 550*b*, 560*a* and 560*b* from upstream in the conveying direction of the recording medium W. The heater unit 350 further includes a discharge-specific conveyer roller 570 and a controller 580. The controller 580 executes control processes to control heating (temperatures) of respective heaters 541*a* to 561*b* of the heating rollers 540*a* to 560*b*.

The recording medium W conveyed by the outfeed roller 335 and the feed nip roller 336 is alternately conveyed via the heating rollers 540*a* to 560*b* to pass through the heater unit 350 by a feed roller 359 and a feed nip roller 360. The heating rollers 540*a* to 560*b* are rotationally driven by the conveyed recording medium W while heating the conveyed recording medium W to evaporate the pretreatment liquid L applied to the recording medium W.

The recording medium W having the pretreatment liquid L evaporated in the heater unit 350 is sandwiched between the feed roller 359 and the feed nip roller 360 and transferred to the dancer unit 380.

Note that the heater unit 350 may be excluded when the applied liquid or the recording medium has a fast-dry function or when an installation space for the pretreatment device 220 needs to be secured. In this configuration example, the recording medium W output from the rear surface application mechanism 331 and the surface application mechanism 332 is directly conveyed to the dancer unit 380.

The dancer unit 380 includes two guide rollers 381 and 382, a moving frame 384, a position detector configured to detect the moving frame 384, and two dancer rollers 385 and 386. The moving frame 384 includes an anchor 383 at a lower part of the moving frame 384 to move the anchor 383 in directions of an arrow A together with the dancer rollers 385 and 386. The recording medium W is bridged over the two guide rollers 381 and 382 and the two dancer rollers 385 and 386 in a W-shape.

The dancer unit 380 controls the conveyed amount of the feed roller 359 based on an output of the position detector to control a position in a vertical direction of the moving frame 384. The position of the moving frame 384 is adjusted so as to provide a buffer for the recording medium W between the pretreatment device 220 and a posttreatment recording device 230.

The recording medium W heated by the heater unit 350 is cooled by the dancer unit 380, and subsequently conveyed to the posttreatment recording device 230.

This configuration allows the pretreatment device 220 to apply the pretreatment liquid L to the recording medium W and transfer the recording medium W to the posttreatment recording device 230. The pretreatment liquid L applied by the pretreatment device 220 to the recording medium W may improve the quality of images on the recording medium W by aiding the permeation and by preventing feathering, show-through, or bleed through of the ink due to ink density or color tone.

Application Mechanism of First Embodiment

Figure 3A:
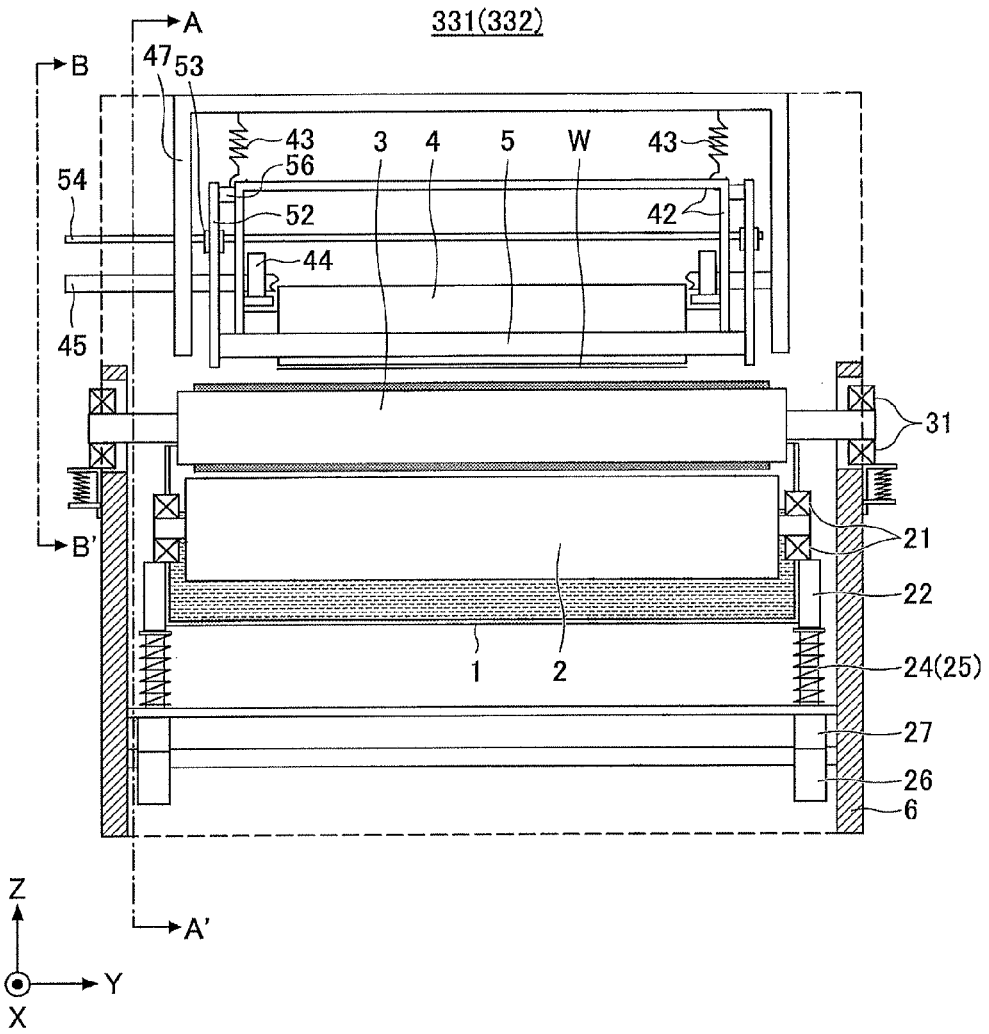
FIGS. 3A and 3B are diagrams illustrating an application mechanism included in a pretreatment liquid application device illustrated in FIG. 2 when a pressure roller moves away from an application roller, where
Figure 3B:
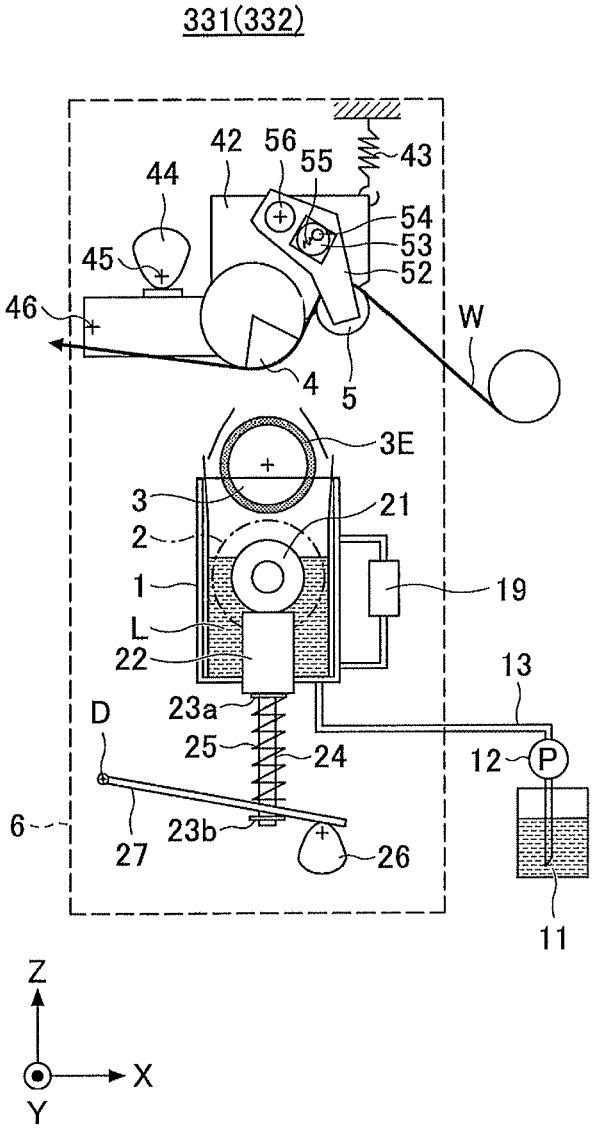

FIGS. 3A and 3B are diagrams illustrating the application mechanism 331 (332) included in the pretreatment device 220 illustrated in FIG. 2 when the pressure roller 4 moves away from the application roller 3. FIG. 3A is a schematic diagram illustrating the application mechanism 331 (332) in a roller extending direction of the application roller 3 and FIG. 3B is a schematic diagram illustrating the application mechanism 331 (332) in a roller axis direction of the application roller 3.

Note that the rear surface application mechanism 331 and the surface application mechanism 332 illustrated in FIG. 2 have the identical structural configurations, and an illustration below is thus given on the basis of the rear surface application mechanism 331. Note that in the rear surface application mechanism 331 and the surface application mechanism 332 illustrated in FIG. 2, the supply pan 1*r* and supply pan 1*f* have identical structural configurations, the squeeze roller 2*r* and squeeze roller 2*f* have identical structural configurations, the application roller 3*r* and the application roller 3*f* have identical structural configurations, the pressure roller 4*r* and pressure roller 4*f* have identical structural configurations, and the winding roller 5*r* and winding roller 5*f* have identical structural configurations; and reference numerals of these components are partially omitted in the illustration given below.

The rear surface application mechanism 331 according to a first embodiment includes a squeeze roller mechanism 20 having a supply pan 1 and a squeeze roller 2, an application roller mechanism 30 having the application roller 3, and a pressure unit 40 (see FIG. 5) having a pressure roller 4 and a winding roller 5.

The pressure unit 40 may also be referred to as a lifting mechanism, a lifting mechanism, and a moving mechanism. The pressure unit 40 having the pressure roller 4 is removably fixed to a housing 6. The supply pan 1 serving as a treatment liquid container contains a treatment liquid. The application roller 3 and the squeeze roller 2 are disposed inside the supply pan 1 and are rotationally fixed to the supply pan 1.

The supply pan 1 of the rear surface application mechanism 331 is connected to the pretreatment liquid L supply unit 340 serving as a cartridge configured to supply the pretreatment liquid L. The supply pan 1 is disposed close to the rear surface application mechanism 331 and is connected to a pooling tank 11 configured to temporarily pool the pretreatment liquid L. The pretreatment liquid L fed from the pretreatment liquid L supply unit 340 and pooled in the pooling tank 11 is supplied to the supply pan 1 by a pump serving as an electrically driven liquid transfer unit such as a tubing pump or a diaphragm via a supply path 13 and a solenoid valve.

The pretreatment liquid L pooled in the supply pan 1 is scooped by the rotation of the squeeze roller 2 driven by an application adjusting motor 18*a* of a motor unit 18 (see a second embodiment in FIG. 10) via a gear 18*b*.

The amount of the pretreatment liquid L scooped by the squeeze roller 2 may be less affected by using an anilox roller or a wire bar having a dimpled surface when the viscosity of the pretreatment liquid L or a printing rate is changed.

The pretreatment liquid L scooped by the squeeze roller 2 is partially removed by a contact part (an application amount adjusting nip) between the application roller 3 covered with an elastic member such as rubber and the squeeze roller 2 such that the pretreatment liquid L remaining on the squeeze roller 2 is thinly and uniformly spread over the application roller 3.

Two ends of the application roller 3 are supported by respective bearings 31 that are rotated with respect to the recording medium W or are driven by the conveyance of the recording medium W.

The pressure roller 4 is attached to the pressure unit 40 serving as the lifting mechanism to elastically press the pressure roller 4 to the application roller 3 for applying the pretreatment liquid L.

In the rear surface application mechanism 331, the squeeze roller 2 is disposed at a lower part of the application roller 3 covered with an elastic member 3E, and the pressure roller 4 is disposed at an upper part of the application roller 3. The squeeze roller 2, the application roller 3, and the pressure roller 4 are moved in a vertical direction.

Figure 4A:
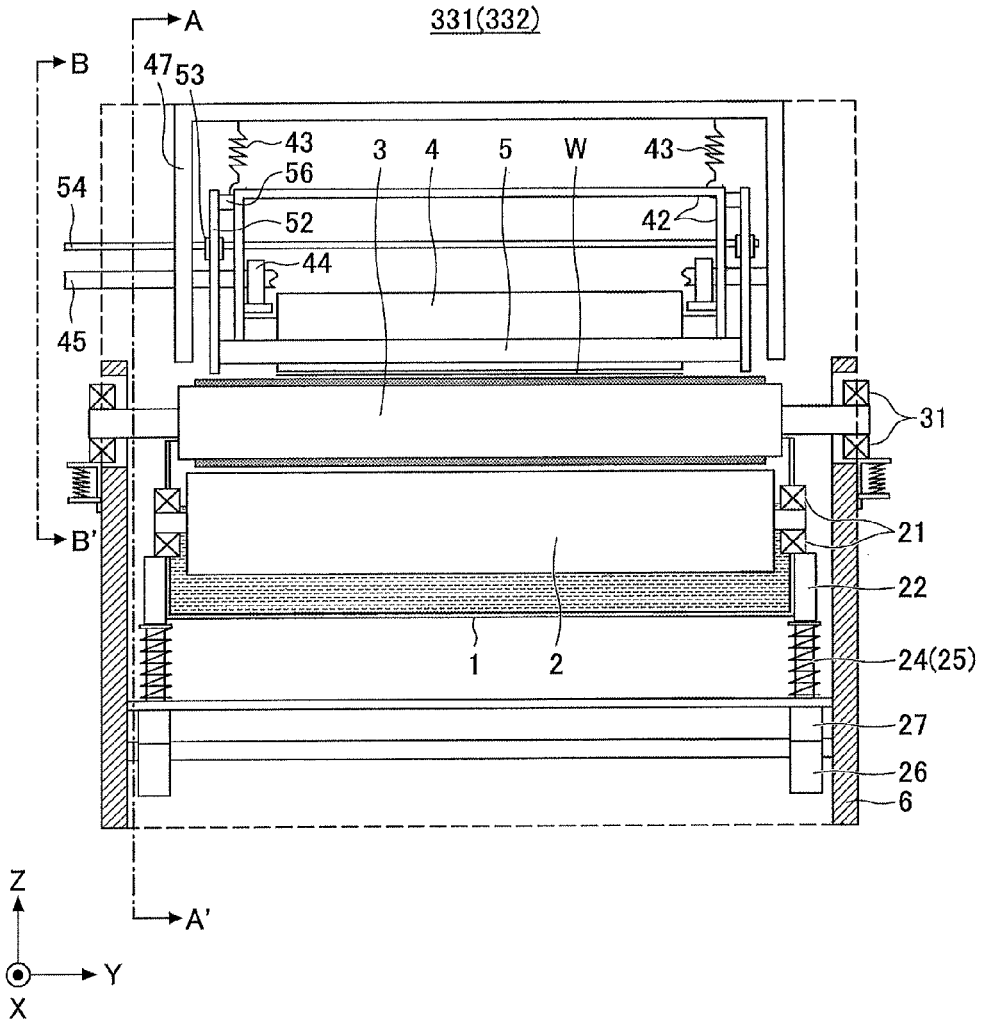
FIGS. 4A and 4B are diagrams illustrating the application mechanism illustrated in FIG. 2 when the pressure roller is in contact with the application roller, where
Figure 4B:
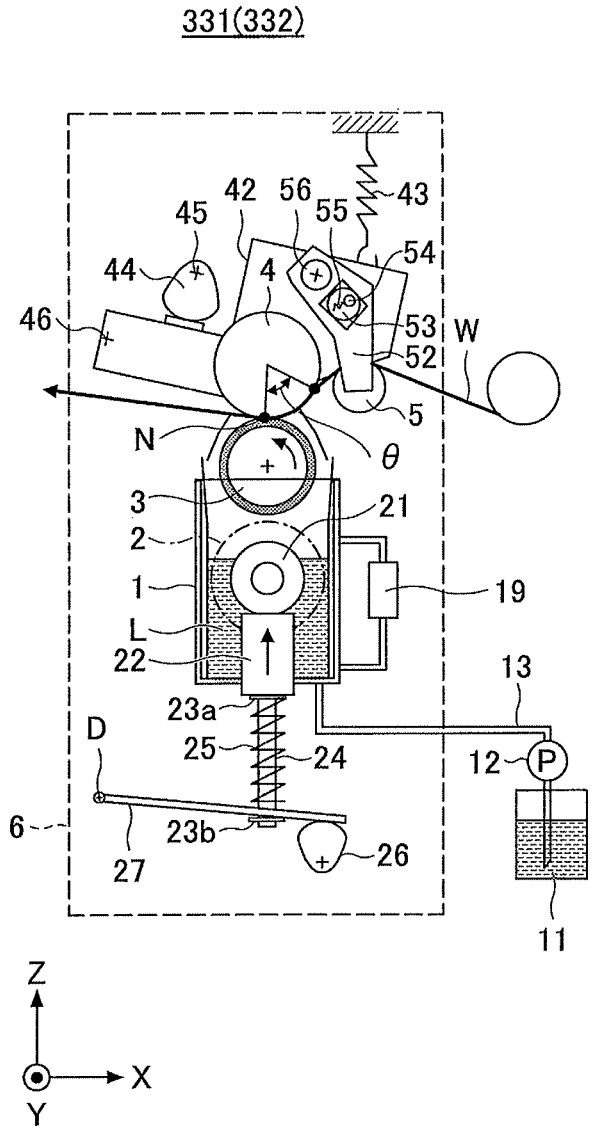

FIGS. 4A and 4B are diagrams illustrating the application mechanism 331 (332) illustrated in FIG. 2 when the pressure roller 4 is in contact with the application roller 3. FIG. 4A is a schematic diagram illustrating the application mechanism 331 (332) in a roller extending direction of the application roller 3 and FIG. 4B is a schematic diagram illustrating the application mechanism 331 (332) in a roller axis direction of the application roller 3.

The squeeze roller 2 and the pressure roller 4 are disposed to be in contact with the application roller 3 in an approximately vertical direction as illustrated in FIG. 4B when applying the pretreatment liquid L.

However, if the squeeze roller 2 or the pressure roller 4 is in contact with the application roller 3 that is not rotated, the elastic member 3E of the application roller 3 may be slightly deformed. The slightly deformed elastic member 3E of the application roller 3 may cause non-uniform application of the pretreatment liquid L.

In the rear surface application mechanism 331 according to the first embodiment, the squeeze roller 2 or the pressure roller 4 is separated from the application roller 3 when the pretreatment liquid L is not applied as illustrated in FIGS. 3A and 3B.

As illustrated in FIGS. 3B and 4B, the two ends of the squeeze roller 2 are provided with respective bearing members 21 such as bearings. The squeeze roller 2 is pressed up to the application roller 3 to form a nip or is pressed down to the application roller 3 via respective roller holders 22 supporting the bearing members 21 of the squeeze roller 2.

Bar-shaped holder support members 23 are coupled to lower parts of the roller holders 22 at the two ends of the squeeze roller 2. Washers 23*a* and 23*b* are attached at a middle position and a lower end of each of the holder support members 23. A slightly compressed coil-shaped lifting spring 25 is attached between the washers 23*a* and 23*b*.

The lower part of the lifting spring 25 is supported by an arm 27. A squeeze cam 26 is disposed on a free end opposite to a point D of the arm 27. The free end of the arm 27 is thus constantly in contact with the squeeze cam 26 by the elasticity of the lifting spring 25. The arm 27 pivots on the point D as a pivotal fulcrum (pivots on the center of a circle along the arc) by the rotation of the squeeze cam 26. The arm 27 is lifted to compress the lifting spring 25 by rotation of the squeeze cam 26. The rotational axis of the squeeze cam 26 at this moment is located at a lower position. The spring load is propagated to the squeeze roller 2 via the holder support members 23, the roller holders 22, and the bearing members 21 to lift the squeeze roller 2 up to the application roller 3 to form a nip.

Note that the squeeze roller 2 is rotationally attached to (fitted in) a side frame of the supply pan 1. The supply pan 1 is relatively supported with respect to the housing (frame) 6 of the rear surface application mechanism 331 to be lifted up or down along the frame. Accordingly, when the squeeze roller 2 is lifted up by the rotation of the squeeze cam 26, the supply pan 1 is also lifted up so as to allow the squeeze roller 2 to be in contact with the application roller 3.

The pretreatment liquid L is supplied by the pump 12 to the supply pan 1 from the pooling tank 11. The squeeze roller 2 is partially immersed in the pretreatment liquid L even when the squeeze roller 2 is lifted toward the application roller 3.

Pressure Lifting Unit

Figure 5:
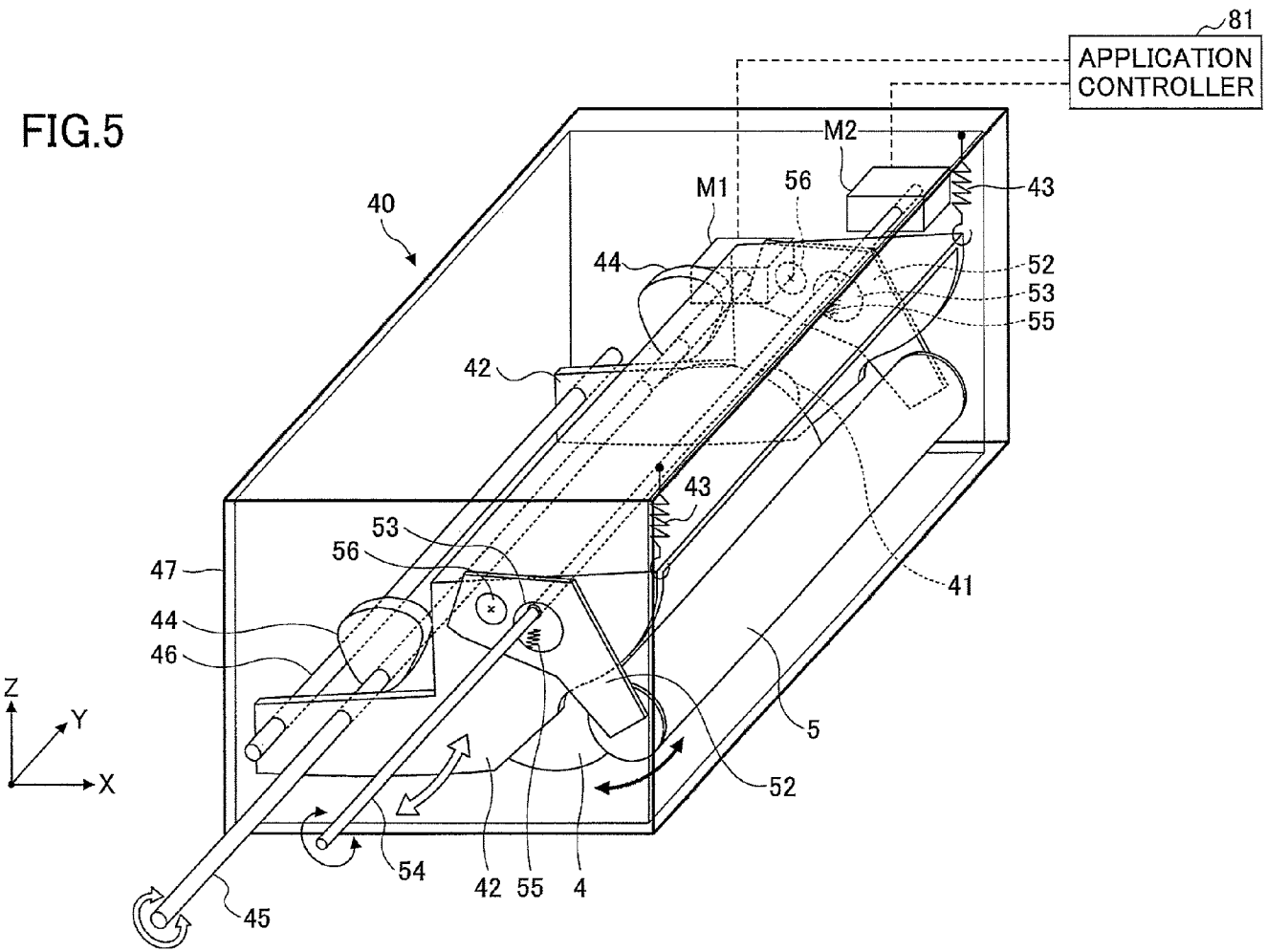
FIG. 5 is a perspective diagram illustrating a moving mechanism of the pressure roller and the winding roller illustrated in FIGS. 3A and 3B.

FIG. 5 is a perspective diagram illustrating a moving mechanism (a lifting mechanism) of the pressure roller 4 and the winding roller 5 illustrated in FIGS. 3A and 3B. The pressure unit 40 includes supporting arms (pressure roller supporting members) 42 configured to support the pressure roller 4. The supporting arms 42 are attached to respective ends of the pressure roller 4. The supporting arms 42 partially form the lifting mechanism. The pressure unit 40 serving as the lifting mechanism of the pressure roller 4 includes a tension spring 43 connected to a ceiling of a housing 47 of the pressure unit 40 at an end opposite to a rotational shaft 46 of the supporting arms 42. Eccentric cams (pressure roller eccentric cam) 44 are disposed near respective centers of the supporting arms 42.

As illustrated in FIGS. 3A to 5, the two ends of the pressure roller 4 are rotationally supported by respective free ends of the supporting arms 42. The supporting arms 42 are pulled by the tension springs 43 in a counter-clock direction on the rotational shaft 46 as the center. The tension springs 43 of the supporting arms 42 are provided with respective cams (eccentric cams) 44. The pressure eccentric cams 44 are attached to a shaft 45.

When applying the pretreatment liquid L, the pressure unit 40 serving as the lifting mechanism causes the pressure roller 4 to elastically press the application roller 3 by the rotation of the pressure eccentric cams 44 caused by the principle of the lever.

When not applying the pretreatment liquid L, the pressure unit 40 moves the pressure roller 4 upward to separate the application roller 3 from the pressure roller 4 to cancel the contact (the application nip N). In this case, the pressure roller 4 is moved away from the application roller 3 against the elastic force of the tension springs 43 by the rotation of the pressure eccentric cams 44 in contact with the respective supporting arms 42 disposed between the pressure roller 4 and the tension springs 43.

In the pressure unit 40, the pressure roller 4 elastically presses the application roller 3 when the pretreatment liquid L is being applied. When the pretreatment liquid L is not being applied, the pressure roller 4 is moved upward to cancel the contact between the application roller 3 and the pressure roller 4.

When the supporting arms 42 pivot, the pressure roller 4 is lifted up or down relative to the application roller 3 at the application nip N, and the movement of the pressure roller 4 applies tension to the recording medium W in a width direction in accordance with the recording medium W being drawn by the application roller 3. As a result, a part of the recording medium W to which tension is not applied may form flexure to be wavy.

When the recording medium W having the flexure is continuously conveyed by being sandwiched between the application roller 3 and the pressure roller 4, the waves in the recording medium W are pressed and flattened to form creases at the application nip N serving as a contact part between the pressure roller 4 and the application roller 3.

According to the first embodiment, q winding roller 5 collaboratively moving with the pressure roller 4 is disposed upstream of the application nip N in the recording medium W conveying direction to deflect the recording medium W conveying path, thereby preventing the recording medium W from creasing.

Winding Roller

In the application mechanism 331 (332) of the first embodiment, the pressure unit 40 includes the winding roller 5 of a winding unit 50 (see FIG. 6A) for winding the recording medium W around the pressure roller 4. The winding roller 5 is disposed upstream in the recording medium W conveying direction of the pressure roller 4.

The deflected conveying path is formed for the recording medium W to deflect with respect to the conveying direction when winding the recording medium W around the pressure roller 4 by disposing the winding roller 5 (the winding member) close to the pressure roller 4. This configuration enables the recording medium W to pass through the winding roller 5 disposed upstream in the conveying direction to be wound around the pressure roller 4, and then pass through the application nip N between the pressure roller 4 and the application roller 3 having the pretreatment liquid L applied. The pretreatment liquid L is applied to the recording medium W as a result.

In the winding unit 50 of the first embodiment, two ends of the winding roller 5 are fixed to respective arm-shaped supporting members (winding member supports) 52. A fulcrum 56 serving as a rotational axis of each supporting member 52 is disposed at an end opposite to an end of the supporting member 52 to which the winding roller 5 is fixed, and an eccentric cam (eccentric cam for winding) 53 is disposed between the winding roller 5 and the fulcrum 56.

As illustrated in FIG. 3B, the fulcrum (the rotational axis) 56 is fixed to the supporting arm 42 of the pressure mechanism. The shaft (the eccentric shaft) 54 penetrates the supporting arms 42 at two ends of the pressure roller 4 to be fixed to the supporting arms 42, and the lower surface of the pressure unit 40 is projected from an opening in a wall of the housing 47. In this example, the eccentric shaft 54 of the eccentric cam 53 is rotationally fixed to the supporting arms 42 of the pressure mechanism. That is, the winding roller 5 is attached to the supporting arms 42 that support the pressure roller 4 and rotationally moving around the rotational shaft 46. Note that a lower right corner (a lower right part of FIG. 3B) of the supporting arms 42 includes a cutout part so as not to interfere with moving operations of the winding roller 5.

The eccentric shaft (core) 54 of the eccentric cam 53 projected from walls of the housing 47 of the pressure unit 40 is rotated manually or by using a winding adjustment motor M2 (se FIG. 5), which eccentrically rotates the eccentric cam 53 disposed in contact with the supporting member 52. The supporting member 52 thus rotates around the fulcrum 56 as the center.

The positions of the winding roller 5 fixed to respective ends of the supporting members 52 become movable accordingly. As described above, since the supporting members 52 enable the adjustments of the positions of the winding roller 5 with respect to the pressure roller 4, the supporting members 52 enable adjustment of a winding angle θ (see FIG. 4B) of the recording medium W with respect to the pressure roller 4.

Note that the winding angle θ is adjusted by rotating the respective projected eccentric shafts (core) 54 of the eccentric cams 53 either manually or using the winding adjustment motor M2 illustrated in FIG. 5. On the other hand, the pressure unit 40 is lifted up or down by rotating the respective shafts (cores) 45 of the projected eccentric cams 44 either manually or using a lifting adjustment motor M1 (see FIG. 5).

When the eccentric cams 44 or the eccentric cams 53 are rotated manually, space within the pretreatment device 220 is limited. Hence, it may be difficult to rotate these small and thin shafts (cores) 45 and 54 simultaneously within the limited space.

When the eccentric cams 44 and the eccentric cams 53 are eccentrically rotated by rotating the shaft 45 and the eccentric shaft 54 using the lifting adjustment motor M1 and the winding adjustment motor M2, the lifting adjustment motor M1 and the winding adjustment motor M2 are controlled so as not to drive the lifting adjustment motor M1 and the winding adjustment motor M2 simultaneously but to selectively drive only one of the lifting adjustment motor M1 and the winding adjustment motor M2. For example, the application controller 81 may include a selector function to selectively drive one of the lifting adjustment motor M1 and the winding adjustment motor M2.

The adjustment of the winding angle of the pressure roller 4 and the winding roller 5 and the lifting adjustment of the pressure roller 4 are performed by separately rotating the shaft 45 and the eccentric shaft 54. Thus, when the pressure roller 4 is moved by a lifting mechanism in a vertical direction, the winding angle remains unchanged.

One of the shaft 45 and the eccentric shaft 54 is manually rotated while the other is rotated by the corresponding motor. In this case, the shaft 45 and the eccentric shaft 54 are set so as not to rotate the shaft 45 and the eccentric shaft 54 simultaneously.

The necessary winding angle θ remains unchanged in a transient period when the pressure roller 4 is lowered down to the application roller 3 to start printing or when the pressure roller 4 is lifted up from the application roller 3 to stop printing. Thus, the stability of the recording medium W may be secured in a transient period when the pressure roller 4 comes in contact with the application roller 3 or when the pressure roller 4 separates from the application roller 3.

Figure 6B:
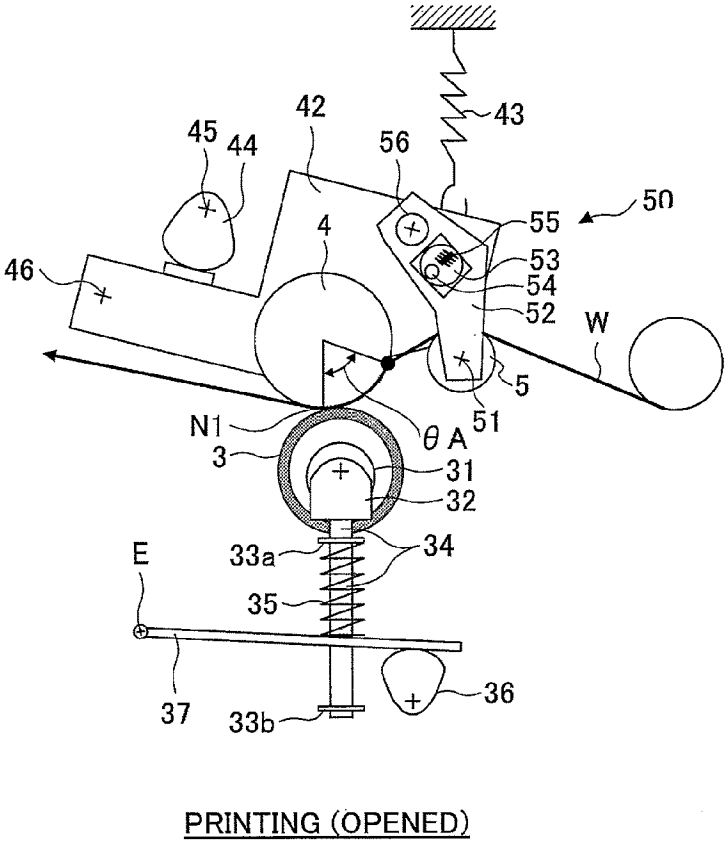
FIGS. 6A and 6B are partial configuration diagrams illustrating a positional relationship between a moving mechanism for the pressure roller and the winding roller, and an application roller when the winding angle is small, where
Figure 6A:
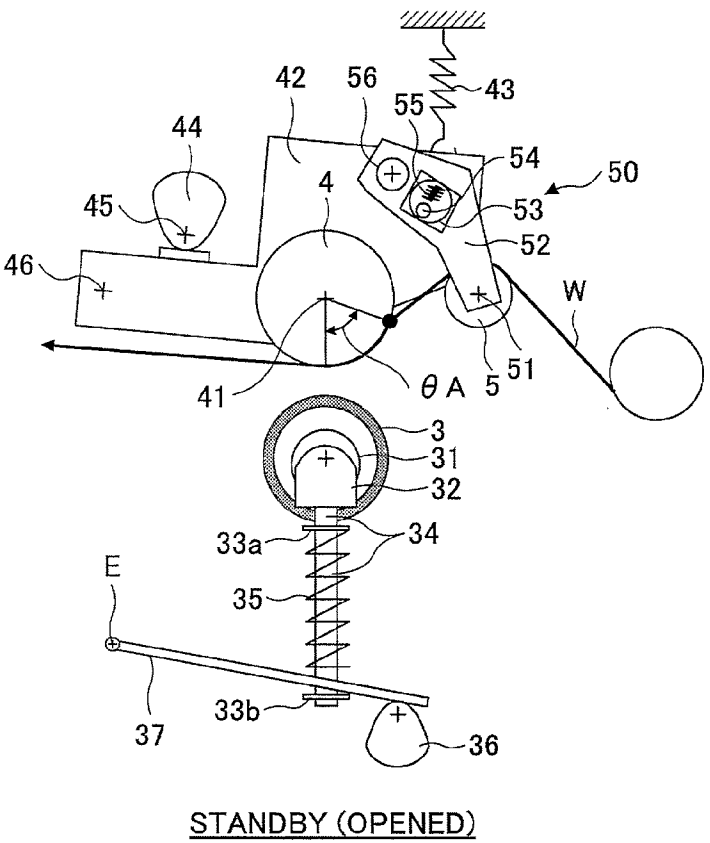

FIGS. 6A and 6B are partial configuration diagrams illustrating a positional relationship between the pressure unit 40 and the application roller 3 when a winding angle is small. Note that the pressure unit 40 serves as the moving mechanism for moving the pressure roller 4 and the winding roller 5. FIG. 6A illustrates a status in which the pressure roller 4 separates from the application roller 3 at non-printing time (an application status is in a standby mode), and FIG. 6B illustrates a status in which the pressure roller 4 is in contact with the application roller 3 at printing time (an application status is in an operating mode).

The transition between the status of FIG. 6A and the status of FIG. 6B is achieved by rotating the eccentric cams 44 using a drive source such as the lifting adjustment motor M1 or the like so as to pivotally turn the supporting arms 42 supporting the pressure roller 4 using the rotational shaft 46 as a pivotal fulcrum.

As illustrated in FIGS. 6A and 6B, respective bearings 31 at opposite ends of the application roller 3 are attached to bearing holders 32, and holder support members 34 are coupled to respective lower parts of the bearing holders 32. A washer 33*a* is disposed at a middle of each holder support member 34 and a washer 33*b* is disposed at a lower end of the holder support member 34. A coil-shaped lifting spring 35 is disposed between the washers 33*a* and 33*b* in a slightly compressed status.

As illustrated in FIGS. 6A and 6B, a lower part of the lifting spring 35 is supported by a corresponding arm 37. The arm 37 includes a point E as a fulcrum, and an application roller cam 36 is disposed at a free end of the arm 37, that is, at an opposite end of the point E of the arm 37. The arm 37 is pivotally moved based on the point E as a pivotal fulcrum along the rotations of the application roller cam 36. The free end (FIG. 6B) of the arm 37 is constantly in contact with the application roller cam 36 by the elastic force of the lifting spring 35.

The application roller cams 36 are rotationally driven by a drive source such as a motor, and rotational angles of the application roller cams 36 are controlled based on signals detected by a rotational angle detector such as' an encoder. The rotations of the application roller cams 36 pivotally move the arms 37 based on respective points E as respective pivotal fulcrums, and the pivotally moved arms 37 compress the respective lifting springs 35 to propagate spring load to the application roller 3 via the holder support members 34, the bearing holders 32, and the bearings 31. The force of the lifting spring 35 is determined by the pivotally moving angle of the pivotally moving arm 37, and the pivotally moving angle of the pivotally moving arm 37 is determined by the rotational angle of the application roller cam 36.

In a period where the pretreatment liquid L is applied to the recording medium W while the recording medium W is conveyed (statuses illustrated in FIGS. 6B and 7C), respective statuses of the lifting spring 35, the arm 37, and the application roller cam 36 are maintained as illustrated in FIG. 6B, and the application roller 3 is located in an upward direction (toward the pressure roller 4).

Figure 7B:
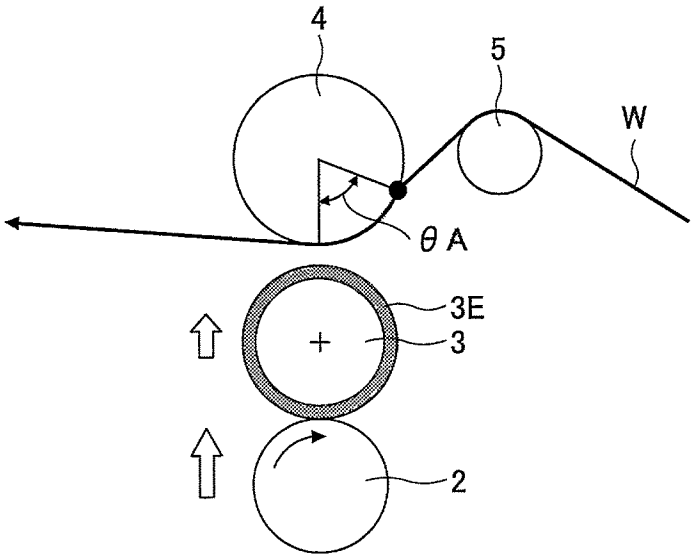
FIGS. 7A to 7D are schematic diagrams illustrating positional relationships between the application roller, the squeeze roller, the pressure roller, and the winding roller illustrated in FIGS. 6A and 6B.
Figure 7A:
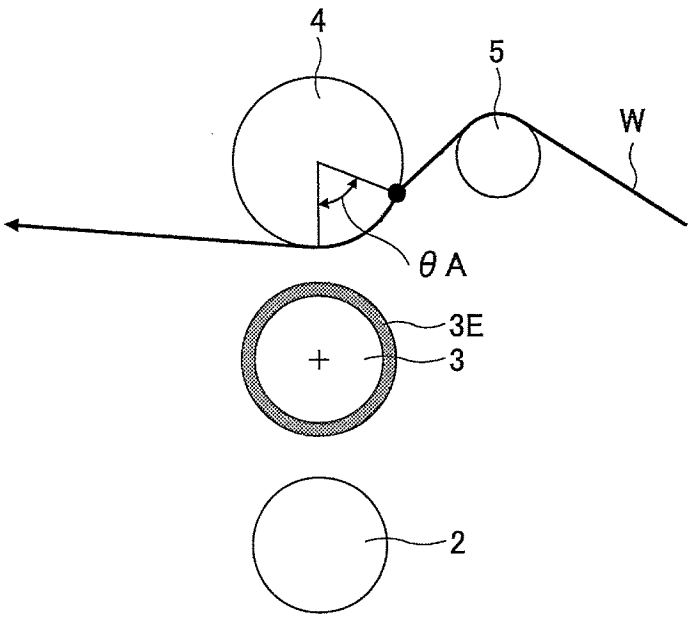
Figure 7D:
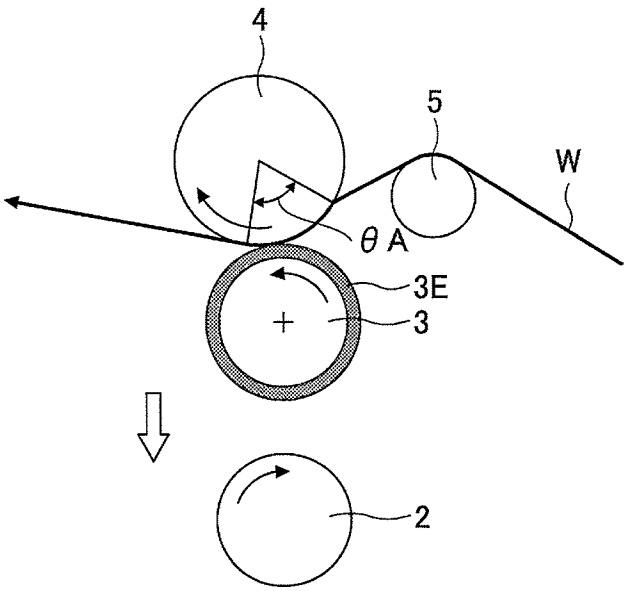

In the statuses illustrated in FIG. 7D in which the recording medium W is stopped being conveyed, the squeeze cam 26 is rotated after the application roller cam 36 has been rotated to cause the application roller 3 to press against the pressure roller 4. The rotations of the squeeze cam 26 moves the squeeze roller 2 in a downward direction to separate from the application roller 3 so as to stop the squeeze roller 2 from supplying the pretreatment liquid L to the application roller 3.

FIGS. 7A to 7D are schematic diagrams illustrating positional relationships (a contact status or a non-contact status between the squeeze roller 2, the application roller 3, the pressure roller 4, and the winding roller 5) between the application roller 3, the squeeze roller 2, the pressure roller 4, and the winding roller 5 illustrated in FIGS. 3A and 3B, and FIGS. 6A and 6B. The elastic member 3E of the application roller 3 is controlled to be in contact with the squeeze roller 2 and the pressure roller 4 only while the squeeze roller 2 supplies the pretreatment liquid L to the application roller 3 by lifting operations of the squeeze roller 2, the application roller 3 and the pressure roller 4 so as to prevent the elastic member 3E from being degraded to increase the life of the elastic member 3E.

FIG. 7A illustrates a standby status before the pretreatment liquid L is applied. In FIG. 7A, the squeeze roller 2 is located at a lower position, the application roller 3 is located at a lower position, and the pressure roller 4 is located at a higher position. The squeeze roller 2, the application roller 3, and the pressure roller 4 are separated from one another in manners similar to cases in FIG. 3B and FIG. 6A. In this case, the application device as a whole is illustrated in FIGS. 3A and 3B.

In this standby status, the recording medium W is stopped being conveyed, and the application roller 3 and the squeeze roller 2 are stopped being rotated.

When the standby status is changed to the application status, the squeeze cam 26 is rotated to move the squeeze roller 2 in an upward direction before the recording medium W is conveyed. Simultaneously, the application roller cam 36 is rotated to move the application roller 3 in an upward direction as illustrated in FIG. 6B. Note that the moving amount of the squeeze roller 2 is greater than the moving amount of the application roller 3, and the squeeze roller 2 is pressed in contact with the application roller 3.

After the squeeze roller 2, the application roller 3, and the pressure roller 4 are in a status of FIG. 7B, the squeeze roller 2 and the application roller 3 start rotating by a drive source such as a motor at low speeds in mutually opposite directions. The recording medium W starts being conveyed when the rotations of the squeeze roller 2 and the application roller 3 have become stable.

When the squeeze roller 2 and the application roller 3 have achieved a speed at which the application of the pretreatment liquid L from the squeeze roller 2 to the application roller 3 is secured, the pressure roller 4 is pressed against the application roller 3 to start applying the pretreatment liquid L at the application nip N. In this case, the conveying speed of the recording medium W and the circumferential speed of the application roller 3 are controlled to match the conveying speed of the recording medium W and the circumferential speed of the application roller 3.

Figure 7C:
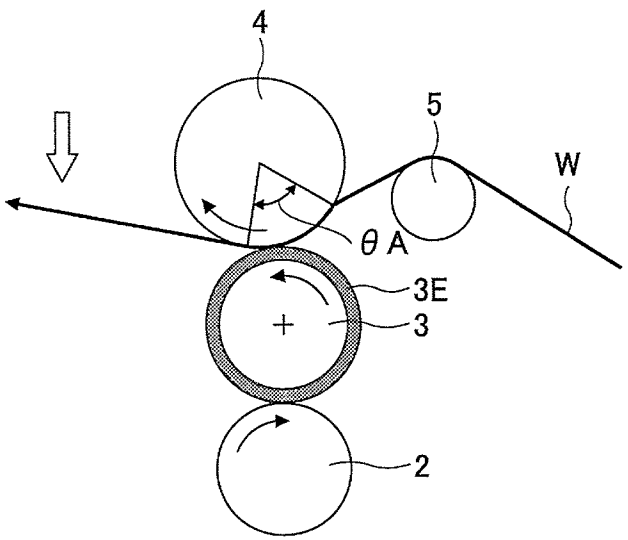

As illustrated in FIGS. 7B and 7C, in a period where the pressure roller 4 approaches the application roller 3 and comes in contact with the application roller 3, a predetermined positional relationship is maintained between the pressure roller 4 and the winding roller 5. The recording medium W may be prevented from creasing along with lowering the pressure roller 4 by maintaining the predetermined positional relationship between the pressure roller 4 and the winding roller 5.

FIGS. 7C and 6B illustrate the application operations in which the pressure roller 4 presses against the application roller 3 by a predetermined amount.

In the application operations, the amount of the pretreatment liquid L to be removed is controlled by changing the load applied to the application amount adjusting nip between the application roller 3 and the squeeze roller 2 when the squeeze roller 2 scoops the pretreatment liquid L inside the supply pan 1.

In addition, the amount of the pretreatment liquid L spread on the surface of the application roller 3 to form a thin film to be transferred to the recording medium W is adjusted by changing the load applied to the application amount adjusting nip between the application roller 3 and the squeeze roller 2, and the pretreatment liquid L is thus applied (transferred and absorbed) to the recording medium W sandwiched between the pressure roller 4 and the application roller 3.

The application controller 81 is coupled to the application mechanism 331 to appropriately adjust the pressing amount based on the application status, and the application controller 81 receives operating instructions associated with printing from the controller of the image forming system 200. The application controller 81 adjusts the amount of the pretreatment liquid L applied by controlling the amount of the pretreatment liquid L supplied to the supply pan 1, by controlling the nip pressure between the application roller 3 and the squeeze roller 2, and by controlling the rotations of the eccentric cams 44 and the eccentric cam 53 (the nip pressure between the application roller 3 and the pressure roller 4, etc.).

To end the application operations, the pretreatment liquid L is stopped being supplied to the application roller 3 by rotating the squeeze cam 26 to separate the squeeze roller 2 from the application roller 3 (see FIG. 5B and FIG. 6B) before the recording medium W stops being conveyed as illustrated in FIG. 7D.

When the conveying speed of the recording medium W is decreased to stop conveying the recording medium W, the rotations of the application roller 3 and the squeeze roller 2 are also stopped. When the conveying speed of the recording medium W reaches a certain speed or lower, the pressure roller 4 is moved in a direction, which allows the pressure roller 4 to be separated from the application roller 3 to restore statuses illustrated in FIGS. 7A and 3B in order to prepare for the next application of the pretreatment liquid L.

Note that the eccentric cams 44 do not rotate simultaneously with the eccentric cams 53. Accordingly, the pressure unit 40 may maintain a predetermined supported status of the winding unit 50 in a period where the pressure roller 4 approaches the application roller 3 to be in contact with the application roller 3, or the pressure roller 4 is detached from the application roller 3 to move away from the application roller 3. As illustrated in FIGS. 7D and 7A, a predetermined distance between the winding roller 5 and the pressure roller 4 determines a predetermined winding angle when the pressure roller 4 is lifted up.

Since a change in the path length when to start printing or when to stop printing is small, a change in tension of the recording medium W or unstable behaviors of the recording medium W (twisting or flexure serving as factors of creasing) may be controlled to secure the stable status of the recording medium W. The recording medium W may be prevented from creasing, which is caused by lifting up or down of the squeeze roller 2, the application roller 3, and the pressure roller 4.

Example if Winding Adjustment

Figure 8B:
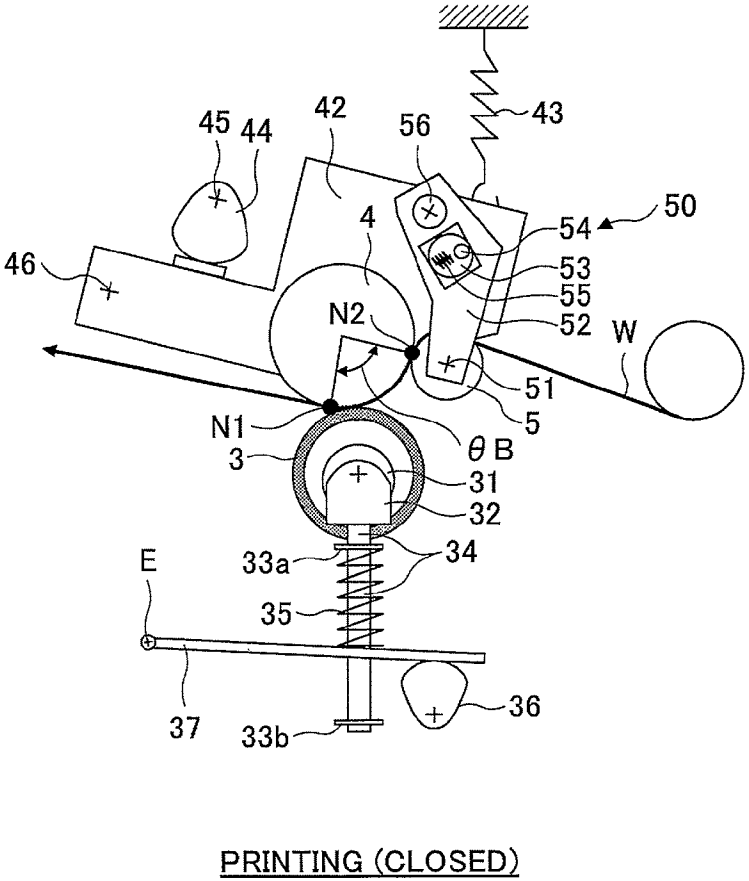
FIGS. 8A and 8B are partial configuration diagrams illustrating a positional relationship between a moving mechanism for the pressure roller and the winding roller, and an application roller when the winding angle is large, where
Figure 8A:
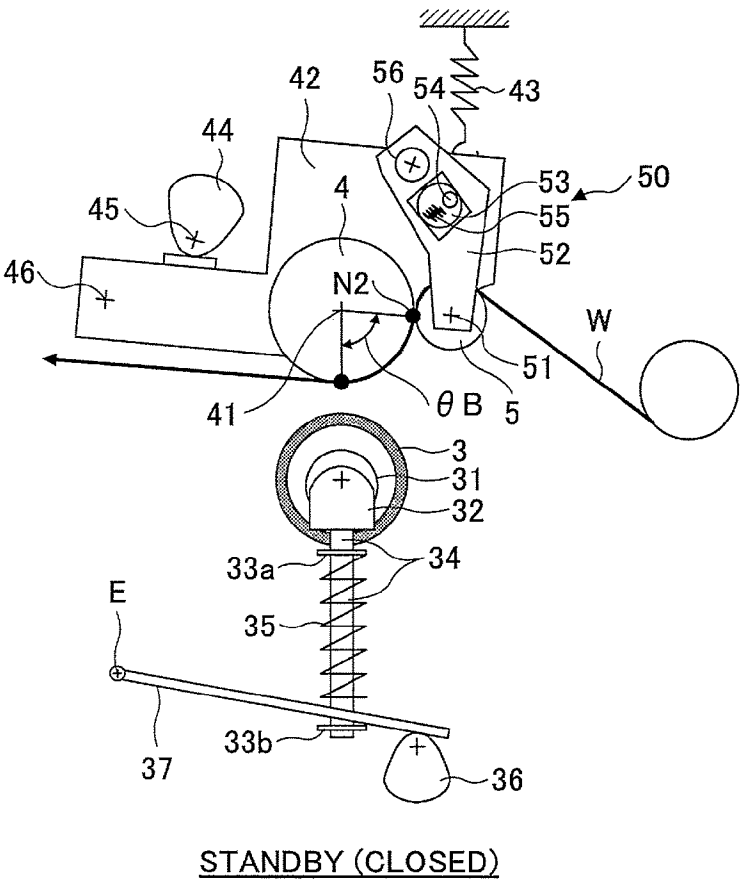
Figure 9B:
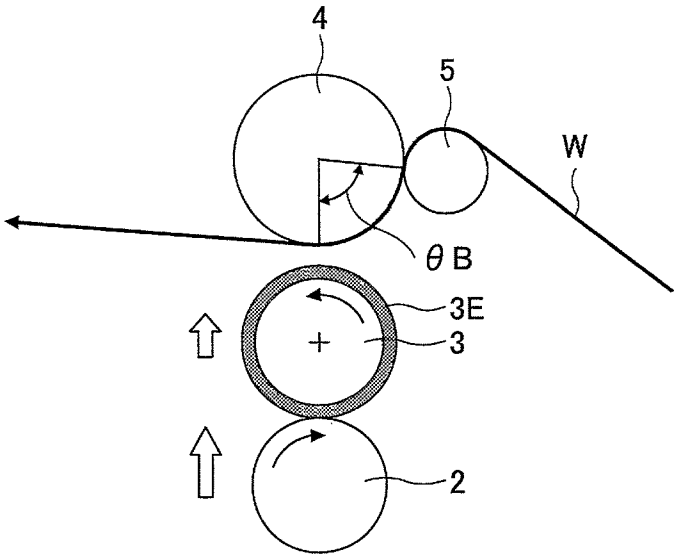
FIGS. 9A to 9D are schematic diagrams illustrating positional relationships between the application roller, the squeeze roller, the pressure roller, and the winding roller illustrated in FIGS. 8A and 8B.
Figure 9A:
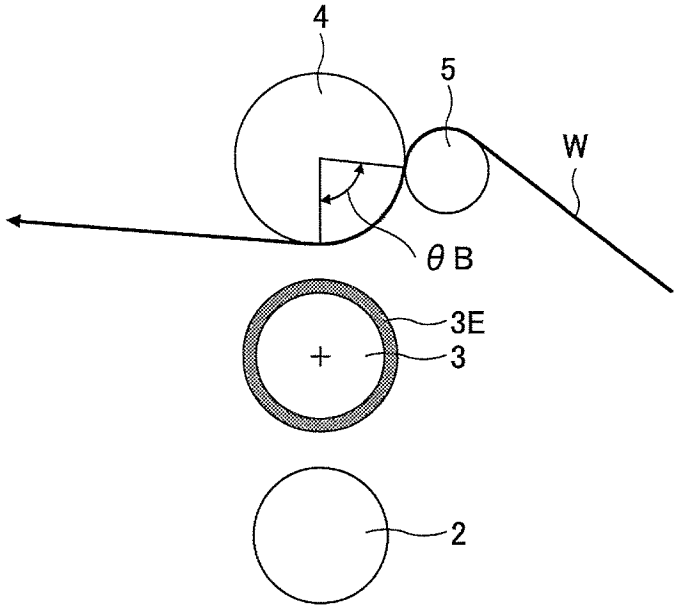
Figure 9D:
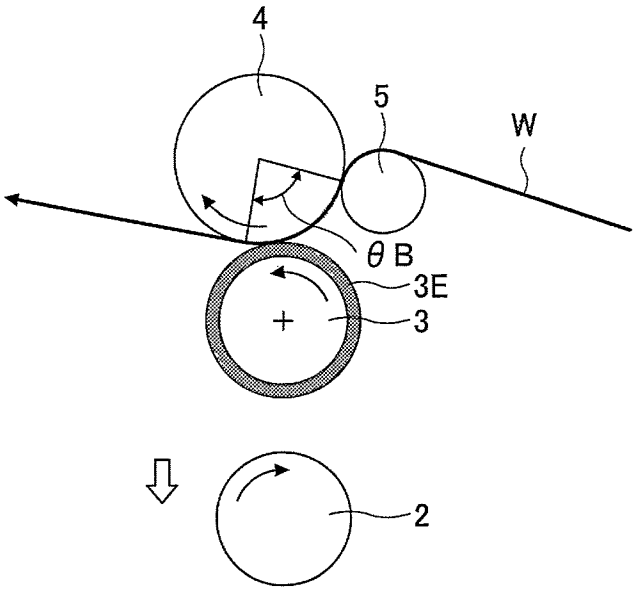
Figure 9C:
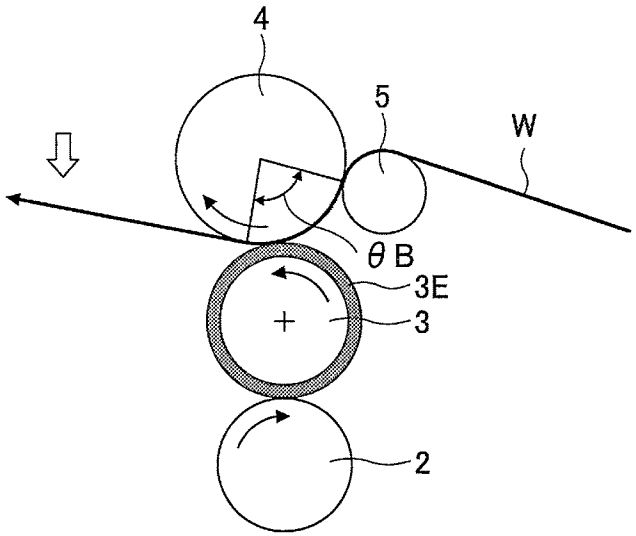

FIGS. 8A and 8B are partial configuration diagrams illustrating a positional relationship between the moving mechanism to which the pressure roller 4 and the winding roller 5 are attached and the application roller 3 when a winding angle is large. FIG. 8A illustrates a status in which the pressure roller 4 separates from the application roller 3 at non-printing time (an application status is in a standby mode), and FIG. 8B illustrates a status in which the pressure roller 4 is in contact with the application roller 3 at printing time (an application status is in an operating mode).

The transition between the status of FIG. 6A and the status of FIG. 6B is achieved by rotating the eccentric cams 44 using the lifting adjustment motor M1 or the like so as to pivotally turn the supporting arms 42 supporting the pressure roller 4 using the rotational shaft 46 as a pivotal fulcrum.

FIGS. 8A and 8B illustrate statuses in which a winding angle θB is greater than the winding angle θA illustrated in FIG. 6B. In status transition illustrated in FIGS. 6A and 6B and FIGS. 8A and 8B, the eccentric shaft (core) 54 of the eccentric cam 53 projected from the wall 57 is rotated manually (or by the winding adjustment motor M2 illustrated in FIGS. 4A and 4B) to eccentrically rotate the eccentric cam 53 to move the supporting member 52 pivotally so as to move the position of the winding roller 5.

As illustrated in FIGS. 8A and 8B, when the winding angle θ is large, the winding roller 5 presses against the pressure roller 4 by the application of certain load. As the pressing mechanism, a compressed spring 55 is embedded in the eccentric cam 53, and the winding roller 5 is pressed against the pressure roller 4 by pressing the compressed spring 55 against the supporting member 52 supporting the winding roller 5.

The pressing load is set to be N1>N2 where N1 represents a nip part between the pressure roller 4 and the application roller 3 at which a sheet on an output side of the pressure roller 4 is detached, and N2 represents a nip part between the pressure roller 4 and the winding roller 5.

In the configuration in which the winding roller 5 presses against the pressure roller 4, the winding angle is increased, the recording medium W is capable of being sufficiently wound around the pressure roller 4 before the recording medium W reaches the application nip N between the application roller 3 and the pressure roller 4, and the recording medium W is pressed by the winding roller 5 against the pressure roller 4. The recording medium W being pressed against the pressure roller 4 is provided with predetermined tension to exhibit a higher stretching (straightening or smoothing) effect.

When thick paper is used as the recording medium W, the thick paper has rigidity and is hard to be wound around the pressure roller pressure roller 4 along the shape of the pressure roller 4. Hence, the recording medium W may be conveyed with stability before entering into the application nip N1 by providing a sufficiently large winding angle to secure a sufficiently long winding length. For example, when an application operation is performed, it may be preferable to dispose the winding roller 5 or adjust the winding roller 5 so as to allow the recording medium W to be wound around the pressure roller 4 by a winding angle of 45 degrees or above to obtain desired stability.

Note that the winding angle θ of winding the recording medium W sandwiched between the nip part N1 and the nip part N2 around the pressure roller 4 is the same angle θ when printing is performed and when printing is not performed.

Since the winding roller 5 is included in the supporting arms 42 configured to move the pressure roller 4 close to the application roller 3 or move the pressure roller 4 away from the application roller 3, the winding angle remains unchanged while lifting the pressure roller 4 up or down. Thus, the winding roller 5 moves in collaboration with the supporting arms 42 configured to move the pressure roller 4.

Compared to a configuration having a winding roller supporter independent from the supporting arms 42, this configuration may reduce a change in the length of the conveying path of the recording medium W caused by movement of the pressure roller 4 close to or away from the application roller 3.

FIGS. 9A to 9D are schematic diagrams illustrating positional relationships between the application roller 3, the squeeze roller 2, the pressure roller 4, and the winding roller 5.

As illustrated in FIGS. 9A to 9D, a predetermined winding angle is formed by maintaining a constant distance between the winding roller 5 and the pressure roller 4 when the pressure roller 4 is lifted up or down. The above configuration reduces a change in the length of the conveying path of the recording medium W by lifting up or down of the squeeze roller 2, the application roller 3, and the pressure roller 4 when starting printing or stopping printing. Thus, a change in tension or unstable behaviors (twist or flexure causing creases) of the recording medium W before entering the application nip N may be controlled, and the formation of creases in the recording medium W may be controlled.

Note that when the winding angle θ is large or when the winding roller 5 is brought in contact with the pressure roller 4, a distance between the pressure roller 4 and the winding roller 5 is narrowed. Thus, it may be difficult to appropriately attach or replace the jammed recording medium W or the rolled recording medium W.

Accordingly, when the recording medium W is attached to the pressure roller 4 and the winding roller 5, the winding angle (amount) is reduced so as to separate the winding roller 5 from the pressure roller 4 as illustrated in FIGS. 6A and 6B. After, the recording medium W is attached, the positions of the supporting members 52 in the supporting arms 42 are adjusted manually or by using the winding adjustment motor M2 by bringing the winding roller 5 in contact with the pressure roller 4 to increase the winding amount (angle) as illustrated in FIGS. 8A and 8B.

In this case, the position of the winding roller 5 with respect to the pressure roller 4 is adjusted or the winding angle of winding the recording medium W around the pressure roller 4 is adjusted in a period in which a predetermined distance is maintained between the pressure roller 4 and the application roller 3. The predetermined distance between the pressure roller 4 and the application roller 3 is maintained when the pressure roller 4 and the application roller 3 are not operated to move the pressure roller 4 and the application roller 3 close to each other or move the pressure roller 4 and the application roller 3 away from each other before the application operation starts or after the application operation ends. That is, the predetermined distance between the pressure roller 4 and the application roller 3 is maintained when the pressure roller 4 and the application roller 3 are separated for attaching the recording medium W, and also while the application operation is performed.

For example, while the application operation is performed, the positions of the supporting members 52 of the winding roller 5 may be adjusted with respect to the supporting arms 42 of the pressure unit 40. As a result, the position of the winding roller 5 (the winding member) with respect to the pressure roller 4 may be adjusted in accordance with a desired amount of the pretreatment liquid L to be applied and a conveying speed of the recording medium W (and/or the rocking speed of the rocking unit).

As described above, when the winding angle illustrated in FIGS. 6A and 6B is small or when the winding angle illustrated in FIGS. 8A and 8B is large, the winding angle or the length of the recording medium W to be wound around the pressure roller 4 remains unchanged while printing is performed and while printing is not performed (other than when the recording medium W is attached). Thus, a stable status of the recording medium W may be secured. As a result, the recording medium W may be prevented from creasing along the lifting operations of the pressure roller 4 for preventing the elastic member 3E of the application roller 3 from deteriorating.

The winding roller 5 according to the embodiment is installed upstream of the pressure roller 4 in a conveying direction of the recording medium W to have the conveying path of the recording medium W curved. Accordingly, even when the wave W1 is formed in a sheet before entering the application nip N as illustrated in FIG. 14 while the application operation is performed, waves may be reduced before the recording medium W reaches the application nip N by winding the recording medium W along the curved conveying path to press the recording medium W against the pressure roller 4. Thus, the recording medium W may be prevented from creasing after the application nip N.

Note that a similar effect of preventing the recording medium W from creasing may be obtained by winding the recording medium W around the application roller 3. In such a case; however, the winding amount of the recording medium W to be wound around the application roller 3 to which the pretreatment liquid L is applied is adjusted. Thus, the amount of the pretreatment liquid L to be applied to the application roller 3 is changed in accordance with the winding amount or the waves formed. In this configuration, it may be difficult to maintain a predetermined amount of the pretreatment liquid L to be applied to the application roller 3 as the application mechanism. Accordingly, it may be preferable to reduce the waves in the recording medium W by allowing the conveying path of the recording medium W to be curved immediately before the application of the pretreatment liquid L, as illustrated in the above embodiment.

Note that the winding roller 5 serving as the winding member may be a bar-shaped member instead of a roller-shaped member to exhibit the same effect; however, it is preferable to select the roller-shaped winding member because the recording medium W passes through better with the roller-shaped winding member.

In the illustration give above, the pressure unit 40 including the winding roller 5 is applied to the rear surface application mechanism 331 illustrated in FIG. 2; however, a similar effect may be obtained when the pressure unit 40 including the winding roller 5*f* is applied to the surface application mechanism 332.

Note that in order to prevent the application roller 3 and the pressure roller 4 from wearing or tearing due to the application roller 3 and the pressure roller 4 being in contact with each other at the edge of the recording medium W, the pressure unit 40 having the pressure roller 4 and the winding roller 5 may be rocked by the application unit 10 inside the application mechanism.

Application Mechanism of Second Embodiment

Figure 10:
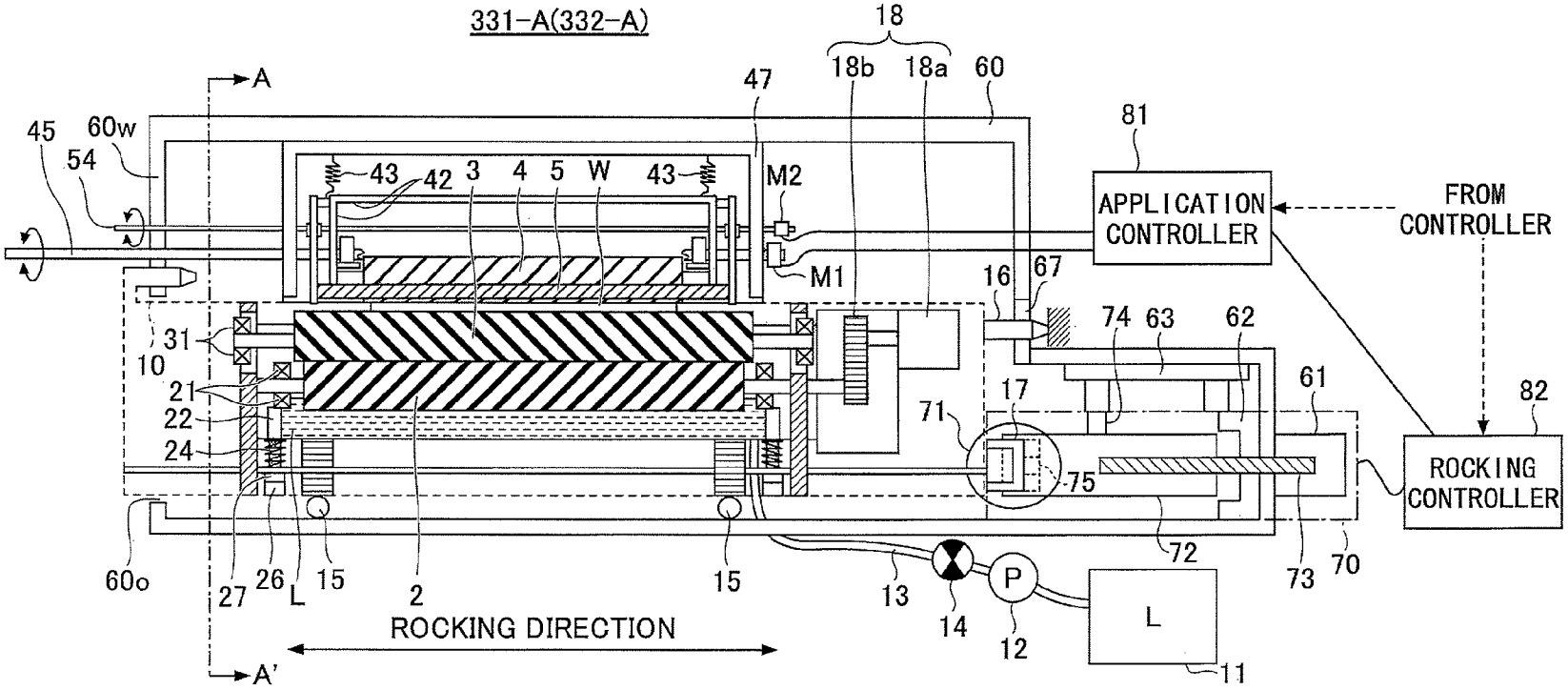
FIG. 10 is a schematic configuration diagram illustrating an application mechanism having a rocking mechanism in a roller extending direction according to a second embodiment.
Figure 11:
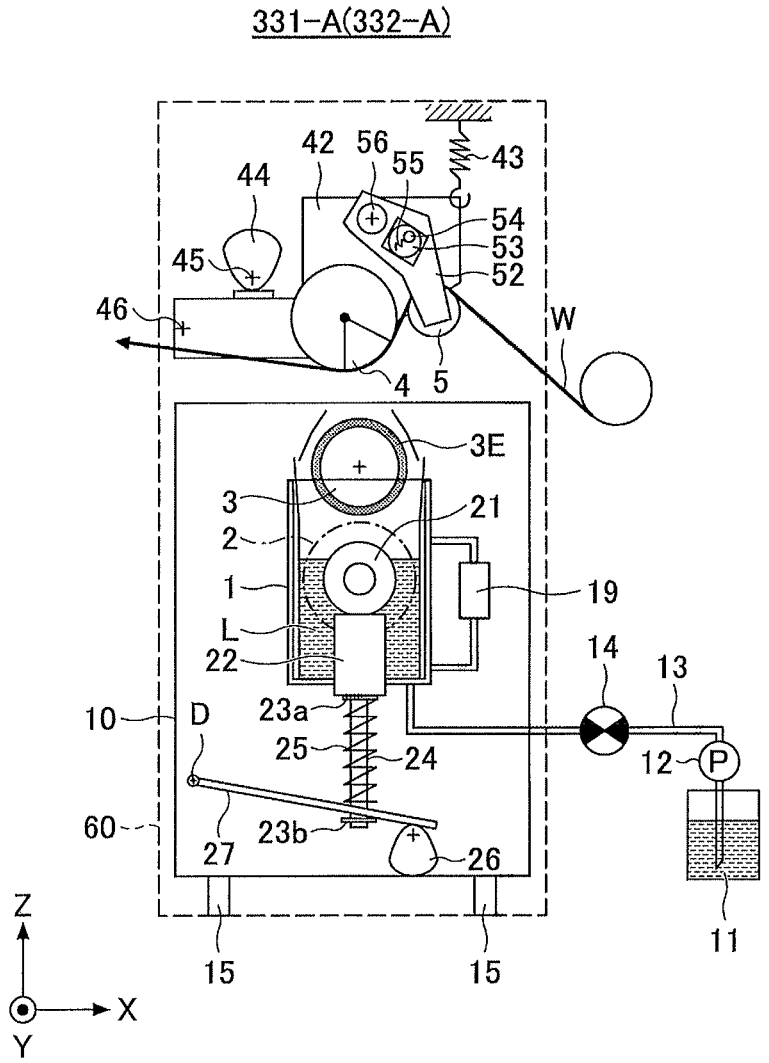
FIG. 11 is a schematic configuration diagram illustrating an application mechanism illustrated in FIG. 10 in a roller axis direction.
Figure 12:
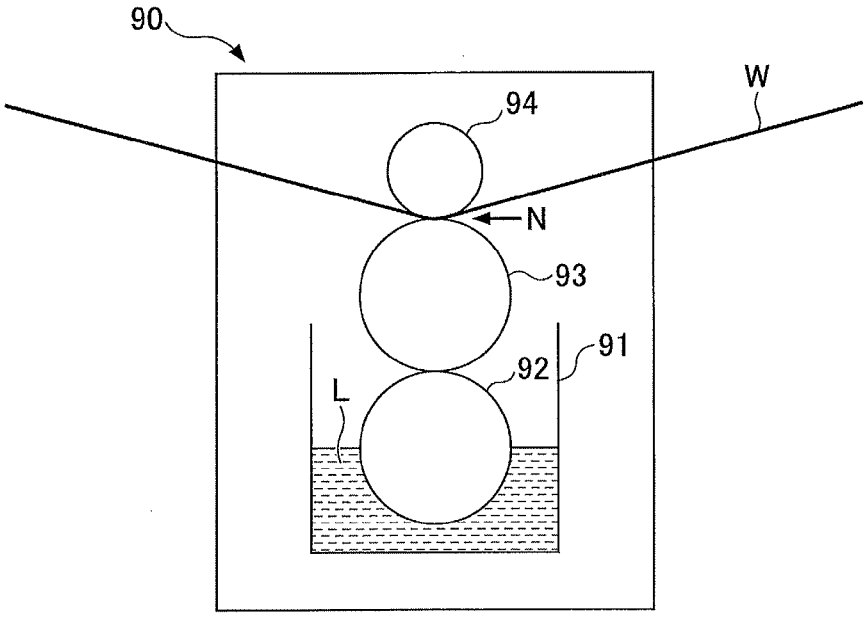
FIG.12 RELATED ART
FIG. 12 is a schematic diagram illustrating an example of a related art application unit.

FIG. 10 is a schematic configuration diagram illustrating an application mechanism having a rocking mechanism in a roller extending direction according to a second embodiment. FIG. 11 is a schematic configuration diagram illustrating the application mechanism illustrated in FIG. 10 in a roller axis direction.

In an application mechanism 331-A or 332-A according to the second embodiment, an application unit 10 having an application roller 3 and a squeeze roller 2 is movably (swingably) disposed in a width direction of a recording medium W (a direction orthogonal to the recording medium W conveying direction) in a housing 60 of the application mechanism 331-A or 332-A.

A part of a moving mechanism 70, an pressure unit (a pressure lifting mechanism) 40, and the application unit 10 are disposed in the housing 60. The application unit 10 is removably attached to the housing 60.

In the second embodiment, the housing 60 has an opening 60*o* in a lower left part of the housing 60 in FIG. 10. To attach the application unit 10 to the rear surface application mechanism 331, the application unit 10 is inserted from the opening 60*o* in a horizontal direction (see an arrow). As the application unit 10 is gradually inserted inside the housing 60, two location pins 16, one disposed upstream and the other downstream in an inserting direction are inserted in respective holes in location plates 67 of the housing 60. As a result, the application unit 10 is located in a recording medium conveying direction (i.e., a depth direction in FIG. 10).

Further, a latch 75 of the moving mechanism 70 is hooked on a latch pin (fitting member) 17 fixed to the application unit 10 to locate the application unit 10 in a width direction of the recording medium W (i.e., a horizontal direction in FIG. 10). The moving mechanism 70 connected to the application unit 10 via the latch pin 17 causes the application unit 10 having a bottom surface with wheels (rollers) 15 to continuously or intermittently rock (linearly rock or reciprocate) in a direction orthogonal to the recording medium W conveying direction. The application unit 10 is moved by causing the wheels 15 to roll on a bottom surface (rails on the bottom surface) of the housing 60 in accordance with force of the moving mechanism 70.

The moving mechanism 70 is indicated by a dash-dot line in FIG. 10. The moving mechanism 70 includes a slider 72, the latch 75 disposed in the slider 72, a location detecting target 74, a screw shaft 73, a frame 62 disposed on an inner wall of the housing 60, and a motor 61 disposed on an outer wall of the housing 60. A latch mechanism 71 is indicated by a circle in FIG. 10. The latch mechanism 71 includes the latch 75 and the like disposed in the slider 72 and in association with fitting of the latch pin 17 of the application unit 10.

The motor (rocking motor) 61 fixed to the housing 60 drives the screw shaft 73, to slide the slider 72 in a width direction of the recording medium W that is in a horizontal direction along the screw shaft 73. The application unit 10 connected to the slider 72 via the latch pin 17 and the latch 75 may be rocked by reciprocating the slider 72 in the width direction. That is, the application unit 10 is moved in the housing 60 by moving the slider (a moving member) 72 connected to the application unit (a treatment liquid container) 10, and the application roller 3 disposed in the application unit 10 rocks in the width direction of the recording medium W with respect to the pressure roller 4.

A position sensor 63 is disposed near the moving mechanism 70. The position sensor 63 having multiple sensors such as photo-interrupters detects a position of the moving mechanism 70 to detect two ends of a moving width of the moving mechanism 70 (the application unit 10). When the position sensor 63 senses one of the ends of the moving width to output a detected result, the moving mechanism 70 is controlled to reverse the moving direction.

The position sensor 63 senses a position of the location detecting target 74 in the moving mechanism 70 and outputs the detected position to an IC chip of a later-described recording medium when printing ends. The detected position is initially retrieved from the IC chip at a next printing and is used for the next printing.

The position sensor 63 includes multiple sensors along the moving direction of the moving mechanism 70, and the sensors at two ends of the moving width of the moving mechanism 70 detect the position of the moving mechanism 70 has reached the two ends of the moving mechanism 70. When printing ends, the position of the moving mechanism 70 is detected by detecting the sensor closest to the moving mechanism 70 or detecting the sensors between which the moving mechanism 70 is located. The moving mechanism 70 may also be provided with a location detecting target 74 for allowing the position sensor 63 to detect a position of the slider 72. The example of the moving mechanism 70 has one location detecting target 74 but the moving mechanism 70 may have two location detecting targets 74.

A rocking controller 82 connected to the moving mechanism 70 is connected to an application controller 81 or a controller of an image forming system 200. The rocking controller 82 controls a moving direction, a moving rate and a driving time of the slider 72 of the moving mechanism 70 based on the amount of application determined based on the type of paper or the resolution, and information such as the printing rate or the position of the detected moving mechanism 70.

The application unit 10 includes the IC chip to store the rocking position (the moving position) and the rocking direction (moving direction) of the application roller 3 at the end of the previous printing. Data of the rocking position and the rocking direction are read from the IC chip for next printing so that printing starts at the rocking position and the rocking direction stored at the end of the previous printing. The above operation may equalize abrasion wear within a range of rocking.

The pretreatment liquid L is applied from the rotating squeeze roller 2 to the application roller 3. The pretreatment liquid L on the application roller 3 is applied to the recording medium W by allowing the recording medium W to pass between the pressure roller 4 and the application roller 3. The recording medium W while being rocked has the pretreatment liquid L applied in the rear surface application mechanism 331, and subsequently passes through the surface application mechanism 332 to reach the heater unit 350.

When a large amount of the pretreatment liquid L is applied to result in low friction resistance between the recording medium W and the application roller 3 to allow the recording medium W to slip on the application roller 3, the rocking mechanism may prevent abrasion of the surface of the application roller 3 at a position where the application roller 3 is in contact with the edge of the recording medium W.

In the application mechanism 331-A, the elastic member 3E of the application roller 3 is controlled to be in contact with the squeeze roller 2 and the pressure roller 4 only while the squeeze roller 2 supplies the pretreatment liquid L to the application roller 3 by lifting operations of the squeeze roller 2, the application roller 3 and the pressure roller 4 so as to prevent the elastic member 3E from being degraded to increase the life of the elastic member 3E in a manner similar to the lifting, operations performed in the application mechanism 331 according to the first embodiment. The predetermined winding angle is formed by maintaining a constant distance between the winding roller 5 and the pressure roller 4 when the pressure roller 4 is lifted up or down. The above configuration reduces a change in the length of the path of the recording medium W by lifting up or down the squeeze roller 2, the application roller 3, and the pressure roller 4 at the start or the end of printing. Thus, a tension change or unstable behaviors (twist or flexure causing creases) of the recording medium W before entering the application nip N may be controlled, and the formation of creases in the recording medium W may be controlled.

When rocking operations are executed, the pressure roller 4 moves close to or moves away from the application roller 3 at the application nip N, and the movement of the application roller 3 applies tension to the recording medium W in a width direction (in reciprocating directions). As a result, a part of the recording medium W to which tension is not applied may form flexure to be wavy.

In accordance with the embodiments, the conveying path of the recording medium W is curved by disposing the winding roller 5 upstream of the application nip N in the conveying direction of the recording medium W. As a result, the recording medium W is pressed against the winding roller 5 to have predetermined tension, which divides various wavy deformations in the recording medium W caused by flexure at the conveyance by rocking, and stretches the sectioned wavy deformations to eliminate the deformations. Thus, the wavy deformations due to the flexure may be reduced so as to prevent the recording medium W from creasing.

The embodiments discussed above employ the pretreatment liquid L as an example of a treatment liquid; however, the treatment liquid may be a posttreatment liquid.

The embodiments discussed above provide a technology to apply pretreatment liquid L or a treatment liquid to a recording medium sandwiched between an application roller and a pressure roller at a position where the application roller is in contact with the pressure roller while preventing the recording medium having flexure in width directions from creasing.

A pretreatment liquid application device 330 includes a recording medium conveying unit (infeed roller) 333 configured to convey a recording medium W, an application roller 3 configured to apply a treatment liquid to the recording medium W, a pressure roller 4 configured to sandwich the recording medium W with the application roller 3 to form a contact part N in order to press the recording medium W for applying the treatment liquid to the recording medium W, and a winding roller 5 disposed close to the pressure roller 4 and configured to form a curved conveying path to have the recording medium W curved with respect to a direction of conveying the recording, medium W to wind the recording medium W around the pressure roller 4.

The pretreatment liquid application device 330 enables the pressure roller 4 to come in contact with the application roller 3 while applying the treatment liquid to the recording medium W, and the pretreatment liquid application device 330 enables the pressure roller 4 to separate from the application roller 3 while not applying the treatment liquid to the recording medium W. The pretreatment liquid application device 330 provides a predetermined positional relationship between the pressure roller 4 and the winding roller 5 in a period in which the pressure roller 4 moves toward the application roller 3 to come in contact with the application roller 3 or in a period in which the pressure roller 4 moves away from the application roller 3.

The embodiments discussed above are capable of applying a treatment liquid to a recording medium sandwiched between an application roller and a pressure roller at a position where the application roller is in contact with the pressure roller while preventing the recording medium having flexure in width directions from creasing.

The embodiments of the present invention are described above; however, the invention is not limited to those specifically described embodiments. Variations and modifications may be made without departing from the scope of the present invention, and the embodiments of the invention may appropriately be defined in a variety of applications.

The present invention is not limited to the specifically disclosed embodiments, and variations and modifications may be made without departing from the scope of the present invention.

What is claimed is:

1. An application device comprising:

a conveyer configured to convey a recording medium;

an application roller configured to apply a treatment liquid to the recording medium;

a pressure roller configured to sandwich the recording medium with the application roller and to press the recording medium against the application roller; and a winding member configured to form a curved conveying path to have the recording medium curved with respect to a conveying direction to wind the recording medium around the pressure roller, wherein the pressure roller comes in contact with the application roller when applying the treatment liquid to the recording medium, and separates from the application roller when not applying the treatment liquid to the recording medium, and wherein the winding member is disposed close to the pressure roller, and a predetermined positional relationship is provided between the pressure roller and the winding member in a period in which the pressure roller moves close to the application roller to be in contact with the application roller or in a period in which the pressure roller moves away from the application roller to be separated from the application roller.

2. The application device according to claim 1, wherein the winding member comes in contact with the pressure roller before the pressure roller sandwiches the recording medium with the application roller to press the recording medium against the application roller.

3. The application device according to claim 1, wherein when an application operation is performed, the winding member is disposed or a position of the winding member is adjusted to allow the recording medium to be wound around the pressure roller by a winding angle of 45 degrees or above.

4. The application device according to claim 1, further comprising:

a rocking unit configured to rock a position of the application roller in a width direction of the recording medium with respect to the pressure roller and the winding member while an application operation is performed.

5. The application device according to claim 1, wherein the curved conveying path that curves the recording medium is directly in contact with the recording medium.

6. The application device according to claim 1, wherein the predetermined positional relationship between the pressure roller and the winding member is maintained by collaboratively moving each of the pressure roller and the winding member.

7. An image forming system comprising:

a conveyer configured to convey a recording medium;

a recording device configured to eject ink toward the recording medium to attach the ejected ink to the recording medium; and an application device disposed upstream of the recording device in a conveying direction of the recording medium, wherein the application device includes an application roller configured to apply a treatment liquid to the recording medium;

a pressure roller configured to sandwich the recording medium with the application roller and to press the recording medium against the application roller; and a winding member configured to form a curved conveying path to have the recording medium curved with respect to a conveying direction to wind the recording medium around the pressure roller, wherein the pressure roller comes in contact with the application roller when applying the treatment liquid to the recording medium, and separates from the application roller when not applying the treatment liquid to the recording medium, and wherein the winding member is disposed close to the pressure roller, and a predetermined positional relationship is provided between the pressure roller and the winding member in a period in which the pressure roller moves close to the application roller to be in contact with the application roller or in a period in which the pressure roller moves away from the application roller to be separated from the application roller.

8. An application device comprising:

a conveyer configured to convey a recording medium;

an application roller configured to apply a treatment liquid to the recording medium:

a pressure roller configured to sandwich the recording medium with the application roller to press the recording medium against the application roller, and a winding member disposed close to the pressure roller and configured to form a curved conveying path to have the recording medium curved with respect to a conveying direction to wind the recording medium around the pressure roller, wherein the pressure roller comes in contact with the application roller when applying the treatment liquid to the recording medium, and separates from the application roller when not applying the treatment liquid to the recording medium, and wherein a predetermined positional relationship is provided between the pressure roller and the winding member in a period in which the pressure roller moves close to the application roller to be in contact with the application roller or in a period in which the pressure roller moves away from the application roller to be separated from the application roller, and wherein the winding member is supported by a winding member supporter, the pressure roller is supported by a pressure roller supporter, and the winding member supporter is supported by the pressure roller supporter.

9. The application device according to claim 8, wherein a predetermined supporting status of the winding member supporter is maintained in the application roller supporter in a period in which the pressure roller supporter moves the pressure roller close to the application roller to allow the pressure roller to be in contact with the application roller or in a period in which the pressure roller supporter moves the pressure roller away from the application roller.

10. The application device according to claim 8, wherein a supporting status of the winding member supporter in the pressure roller supporter is changed to adjust a position of the winding member with respect to the pressure roller and adjust a winding angle for winding the recording medium around the pressure roller in a period in which the pressure roller supporter maintains a predetermined distance between the pressure roller and the application roller.

11. The application device according to claim 8, further comprising:

a lifting adjustment drive source configured to adjust a position of the winding member and lift up or down the pressure roller with respect to the application roller; and an angle adjustment drive source configured to adjust a supporting status of the winding member supporter in the pressure roller supporter and move the winding member with respect to the pressure roller, wherein one of the lifting adjustment drive source and the angle adjustment drive source is selectively driven.

* * * * *